US009179757B2

(12) United States Patent
Mathiez et al.

(10) Patent No.: US 9,179,757 B2
(45) Date of Patent: Nov. 10, 2015

(54) PRODUCT APPLICATOR DEVICE AND USE THEREOF

(75) Inventors: Jean-Louis Mathiez, Limours (FR); Yannick Hermouet, Saran (FR); Emmanuel Lefol, Saran (FR)

(73) Assignee: Parfums Christian Dior, Paris (FR)

( * ) Notice: Subject to any disclaimer, the term of this patent is extended or adjusted under 35 U.S.C. 154(b) by 289 days.

(21) Appl. No.: 13/976,361

(22) PCT Filed: Jan. 6, 2012

(86) PCT No.: PCT/FR2012/050038

§ 371 (c)(1), (2), (4) Date: Jun. 26, 2013

(87) PCT Pub. No.: WO2012/101353

PCT Pub. Date: Aug. 2, 2012

(65) Prior Publication Data

US 2013/0302081 A1 Nov. 14, 2013

(30) Foreign Application Priority Data

Jan. 27, 2011 (FR) ..... 11 50649

(51) Int. Cl.
*B43K 7/12* (2006.01)
*A45D 40/26* (2006.01)

(52) U.S. Cl.
CPC ..... *A45D 40/26* (2013.01); *A45D 40/264* (2013.01); *A45D 40/261* (2013.01); *A45D 40/265* (2013.01); *A46B 2200/1053* (2013.01)

(58) Field of Classification Search
CPC ..... A46B 2200/1053; A45D 40/262; A45D 40/264; A45D 40/265
USPC ..... 401/107, 108, 109, 111
See application file for complete search history.

(56) References Cited

U.S. PATENT DOCUMENTS 629,133 A 7/1899 Knight et al.
2,629,133 A 2/1953 Morningstar et al.

(Continued)

FOREIGN PATENT DOCUMENTS

DE 1983240 4/1968
DE 8520506 7/1985

(Continued)

OTHER PUBLICATIONS

French Search report from corresponding French Application No. FR 1150649 Report Dated Nov. 9, 2011.

*Primary Examiner* — David Walczak
*Assistant Examiner* — Jennifer C Chiang
(74) *Attorney, Agent, or Firm* — Miller, Matthias & Hull LLP

(57) ABSTRACT

The invention relates to a product applicator device comprising: a reservoir that extends along a central axis between a proximal end and a distal end; a cap that is connected to the distal end of the reservoir, said cap having an opening along the central axis; a spherical plug valve mounted such that it can pivot in the cap in order to selectively open and close the reservoir; and a rod extending along the central axis as far as an applicator head, which rod can move axially between retracted and extending positions. The plug valve is opened and the rod is subsequently extended by actuating a base which is mounted such that it can move with respect to an external body that is solidly connected to the cap.

23 Claims, 35 Drawing Sheets

(56) References Cited

U.S. PATENT DOCUMENTS

| | | | | |
|---|---|---|---|---|
| 3,056,996 | A | 2/1961 | Aversa | |
| 4,768,529 | A | 9/1988 | Mahruki | |
| 5,951,185 | A | 9/1999 | Kingsford et al. | |
| 6,231,256 | B1 | 5/2001 | Kingsford et al. | |
| 6,371,129 | B1 * | 4/2002 | Le Bras-Brown et al. | 132/218 |
| 6,718,990 | B1 | 4/2004 | Neu et al. | |
| 7,237,973 | B1 * | 7/2007 | Lou | 401/116 |
| 8,215,857 | B2 * | 7/2012 | Carroll | 401/107 |
| 8,998,520 | B1 * | 4/2015 | Tanner | 401/99 |
| 2004/0184865 | A1 * | 9/2004 | Carroll | 401/107 |
| 2006/0006778 | A1 | 1/2006 | Lee et al. | |
| 2010/0236567 | A1 * | 9/2010 | Carroll et al. | 132/200 |

FOREIGN PATENT DOCUMENTS

| | | | |
|---|---|---|---|
| EP | 677456 | A1 | 10/1994 |
| EP | 1 568 510 | A2 | 1/2005 |
| FR | 725013 | | 10/1931 |
| FR | 850774 | | 2/1939 |
| FR | 1408868 | | 7/1964 |
| JP | 63163709 | A | 7/1988 |
| WO | WO 01/08530 | A1 | 2/2001 |
| WO | WO 01/60199 | A1 | 8/2001 |
| WO | WO 2005/087042 | A1 | 9/2005 |

* cited by examiner

FIG. 23
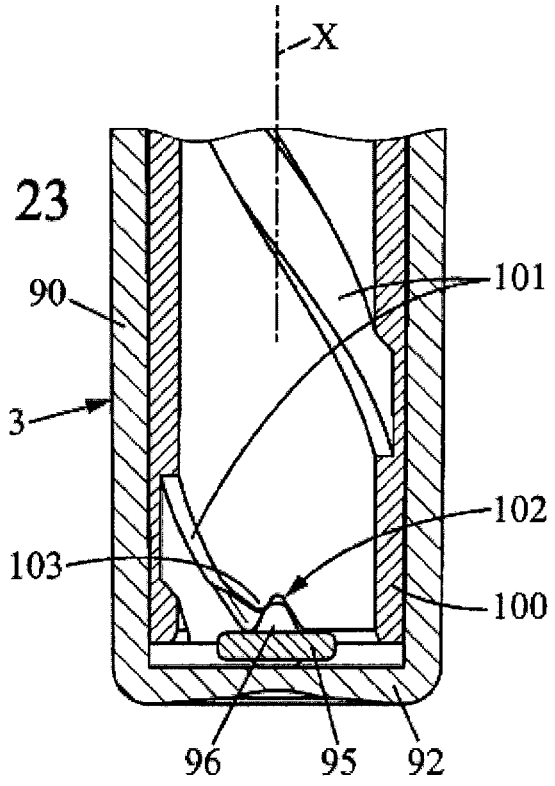
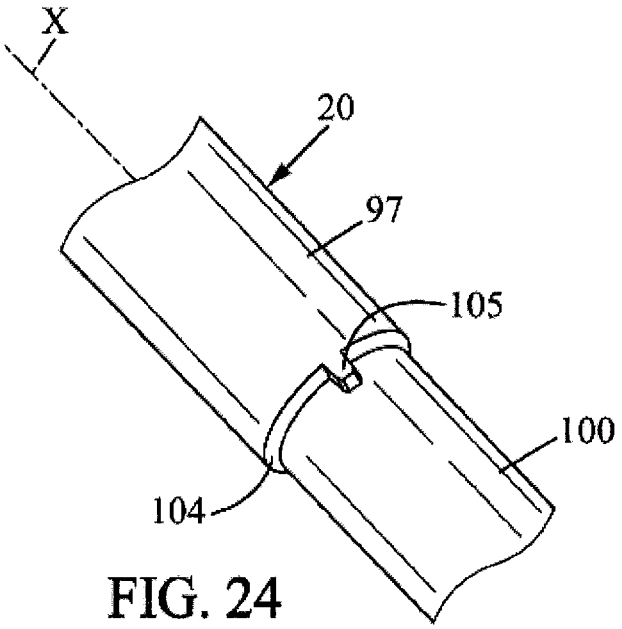
FIG. 24

PRODUCT APPLICATOR DEVICE AND USE THEREOF

CROSS-REFERENCE TO RELATED APPLICATIONS

This application is a 35 USC §371 U.S. national stage filing of International Patent Application No. PCT/FR2012/050038 filed on Jan. 6, 2012, and claims priority under the Paris Convention to French Patent Application No. FR 11 50649 filed on Jan. 27, 2011.

FIELD OF THE DISCLOSURE

1. Field of the Invention

The invention relates to applicator devices for products, particularly cosmetic products such as mascaras, and the use of such devices.

More specifically, the invention concerns a product applicator device comprising:

- a reservoir suitable for containing the product to be applied, this reservoir extending along a central axis between a proximal end and a distal end, and said reservoir being axially open at said distal end,
- a cap that is connected to the distal end of the reservoir, said cap comprising an opening on the central axis,
- a spherical plug valve mounted in the cap so as to pivot about a transverse axis perpendicular to the central axis, said plug valve comprising a central passage perpendicular to the transverse axis and said plug valve pivotable between:
  - a closed position in which said plug valve closes the opening in the cap,
  - and an open position in which said central passage of the plug valve is aligned with the opening in the cap,
- a plug valve control member, movable between a closed position and an open position, and able to place the plug valve in the closed position when said plug valve control member is in the closed position and to place the plug valve in the open position when said plug valve control member is in the open position,
- a rod extending along the central axis to a free end equipped with an applicator head suitable for applying the product, said rod being movable at least translationally along the central axis, between:
  - a retracted position in which the applicator head is positioned within the reservoir,
  - and an extended position in which the rod traverses the central passage of the plug valve and the applicator head is outside the reservoir.

2. Background of the Disclosure

Document WO01/60199 describes an example of an applicator device of this type, in which the user wanting to use the applicator must first directly actuate the plug valve control member to open the plug valve, then actuate a rod control member to cause the applicator head to exit through the plug valve. The ergonomics of the applicator are therefore unsatisfactory, because the user must successively actuate two control members without any guide as to the sequence of actions to be completed. In addition, the control members may be actuated accidentally, particularly the plug valve control member. This can result in the product leaking or drying out, which always affects the quality of any cosmetic product, particularly mascara.

SUMMARY OF THE DISCLOSURE

The invention aims to overcome these disadvantages.

For this purpose, in the invention, an applicator device of the type in question is characterized by the plug valve control member being rotatable about the central axis, between the closed position and the open position,

- and by the reservoir being mounted within an external body solidly connected to the cap,
- and by the rod traversing the proximal end of the reservoir and being mounted in a base which axially extends the reservoir from the proximal end of said reservoir, said base being movable relative to the external body along an actuating path comprising a first path section between a rest position and an intermediate position, and a second path section between said intermediate position and a utilization position, said first path section comprising a rotational movement of the base relative to the external body about the central axis, said base being coupled to the plug valve control member so as to rotate said plug valve control member from the closed position to the open position when the base is moved from the rest position to the intermediate position, and said base being adapted to move the rod from the retracted position to the extended position during the second path section.

The ergonomics of the applicator are clearly improved by these arrangements, as the user only needs to move the base relative to the external body along the base actuating path, which easily causes the plug valve to open and the applicator head to then exit, with the proper sequence of these operations imposed by the actuating path. The risk of actuating the control members has been eliminated and the seal protecting the product is improved.

In various embodiments of the applicator according to the invention, one or more of the following arrangements may be used:

- the applicator device comprises a piston mounted so as to slide in the reservoir while maintaining the seal and traversed by the rod while maintaining the seal, the piston being resiliently biased towards the distal end of the reservoir;
- the piston is resiliently biased by a piston spring having a first end related to the rod (particularly by its pressing against a portion of the rod or against a part separate from but solidly connected to the rod) and a second end pressing against the piston. This allows the piston spring to bias the piston towards the distal end of the reservoir essentially while the device is in the utilization position and not continually, which prevents it from causing product leaks due to the action of the piston spring;
- the distal end of the reservoir comprises a wringer which is adapted to wring the applicator head and/or the rod when said applicator head exits the reservoir, the free end of the rod being adapted to establish a seal with the wringer when the rod is in the retracted position, said rod additionally comprising an intermediate portion which is located before the applicator head and which is adapted to establish a seal with the wringer when said rod is in the extended position: this guarantees a more or less continuously sealed closure of the reservoir, except while the applicator head is extended, which prevents the product in the container from drying out and prevents product leakage;
- the plug valve control member comprises a pin slidingly engaged in an angled groove of the plug valve;
- the cap comprises an annular lip, the plug valve is mounted in the cap so as to have play along the central axis, the plug valve control member is mounted so as to have play along the central axis relative to the cap and is resiliently biased towards the plug valve, said plug valve control member coming into contact with the plug valve and pressing said plug valve into axial contact with the lip of the cap;

the plug valve control member is resiliently biased towards the annular lip by a plug valve spring pressing against the reservoir (directly or by means of a supporting ring);

the plug valve spring presses against a supporting ring which itself is supported by the distal end of the reservoir;

the plug valve control member is solidly connected to the reservoir such that it rotates with the reservoir (particularly by interlocking, possibly with some angular play);

the reservoir is mounted so as to rotate with lost motion relative to the external body, about the central axis, said first path section including a rotation of the base with the reservoir about the central axis;

the base is mounted to rotate with lost motion on the reservoir, about the central axis, starting from the initial position of said base, with a range of rotation that is less than the angular extent of the first path section, said first path section including a rotation of the base relative to the reservoir and then a rotation of the base with the reservoir about the central axis;

the base is connected to the reservoir by at least one L-shaped track comprising:

an orthoradial arm which permits said rotation of the base relative to the reservoir during the first path section, and an axial arm parallel to the central axis and allowing the base to slide relative to the reservoir in the direction of the distal end of said reservoir when the base follows the second path section from the intermediate position to the final position;

the base is resiliently biased to move away from the reservoir and is connected to the reservoir by a retention mechanism suitable for selectively either retaining said base in the final position or releasing said base to enable it to move from the final position to the intermediate position;

the retention mechanism is adapted to lock the base in place automatically when it reaches the final position;

the retention mechanism is a two-state mechanism adapted to release the base when it is axially actuated towards the distal end of the reservoir after it had been locked in the final position;

the retention mechanism comprises a winding path arranged in an outer wall of the reservoir, cooperating with a pin supported by an elastic strip solidly connected to the base;

the base is rotatably mounted on the external body and the actuating path comprises a circular movement about the central axis which includes the first and second path sections, the rod being guided by a first track that is integral to the base and by a second track that is integral to the reservoir, so that a rotation of the base relative to the reservoir causes an axial displacement of the rod between the retracted and extended positions;

the first track is parallel to the central axis and the second track is helical;

the reservoir is axially extended beyond its proximal end, by a conveying tube which is solidly connected to said reservoir, the second track extending in a spiral inside the conveying tube between a first end further from the reservoir and a second end closer to the reservoir, the rod extending inside said conveying tube to a rod foot which comprises at least one side post guided in the first and second tracks;

the plug valve control member is solidly connected to the reservoir so as to rotate with it, and is resiliently biased towards the plug valve by a plug valve spring pressing against the reservoir, the reservoir is axially movable within the external body between an engaged position and a disengaged position that is closer to the plug valve than the engaged position, the reservoir and the external body being adapted to:

couple together when the reservoir is in the engaged position, such that the reservoir is then solidly connected to the external body, and uncouple when the reservoir is in the disengaged position, such that the reservoir can then turn freely within the external body, at least the open position of the plug valve control member being a stop position, the base comprises a bottom opposite the reservoir and the conveying tube is axially open facing said bottom, the foot of the rod is adapted to press axially against the bottom of the base when the rod is in the retracted position, and the first end of the second track comprises a catch opening axially towards the bottom of the base and adapted to receive the side post of the foot of the rod when the foot of the rod is pressing against the bottom of the base, the catch and the side post being designed to maintain the reservoir in the disengaged position and to allow the reservoir to be rotated by the base when the side post is engaged with the catch, said catch being designed so that the side post of the foot of the rod can escape said catch when the base is actuated in a first angular direction corresponding to the opening of the plug valve and to the plug valve control member having reached the open position, thus allowing the reservoir to move into the engaged position such that the plug valve is locked in the open position and such that an additional rotation of the base in the first angular direction then results in the side post of the rod sliding in the first and second tracks, causing the applicator head of the rod to exit through the plug valve;

the reservoir is solidly connected to a pin held in place by the plug valve spring while pressing axially against an edge formed in the external body, said edge extending angularly around the central axis between a first stop and a second stop in the first angular direction, and said edge being discontinuous due to an indentation near the second stop, this indentation being adapted to receive the pin of the reservoir when it comes in contact with the second stop, the reservoir being in the disengaged position when the pin of said reservoir is pressing against the edge and being in the engaged position when the pin of the reservoir is within the indentation;

the plug valve control member is mounted so as to slide at an angle relative to the central axis relative to a supporting ring axially pressing against the distal end of the reservoir, such that moving the supporting ring away from the plug valve control member causes the plug valve control member to rotate from the closed position to the open position, the plug valve control member is resiliently biased towards the plug valve by a plug valve spring pressing against the supporting ring, the reservoir is solidly connected to the external body so as to rotate with it but can move axially within the external body between first and second positions, the first position being closer to the plug valve than the second position, the base comprises a bottom opposite the reservoir and the conveying tube is axially open towards said bottom, the conveying tube and the foot of the rod being adapted to alternate in pressing axially against the bottom of the base, the foot of the rod comprises a supporting region that is axially offset towards the bottom of the base relative to the side post of said foot, said supporting region being adapted to press against the bottom of the base when the rod is in the retracted position and the base is in the first path section, while the conveying tube is distanced from the bottom of the base, and the conveying tube is adapted so that it presses against the bottom of the base during the second path section of the base, such that a rotation of the base relative to the external body then causes an axial displacement of the rod relative to the external body.

Another object of the invention is a use of an applicator device as described above, in order to apply a cosmetic product, preferably a liquid or paste, particularly mascara or gloss.

BRIEF DESCRIPTION OF DRAWINGS

Other features and advantages of the invention will be apparent from reading the following description of several of its embodiments, provided as non-limiting examples, and examining the attached drawings.

In the drawings:

FIG. 23 is a cross-sectional view along line XXIII in FIG. 19, FIG. 24 is a detailed perspective view showing the connection between the reservoir and the conveying tube of the applicator device of FIG. 18.

DETAILED DESCRIPTION OF THE DISCLOSURE

The same references are used to denote the same or similar elements in the different figures.

A. First Embodiment of the Invention

Figure 1:
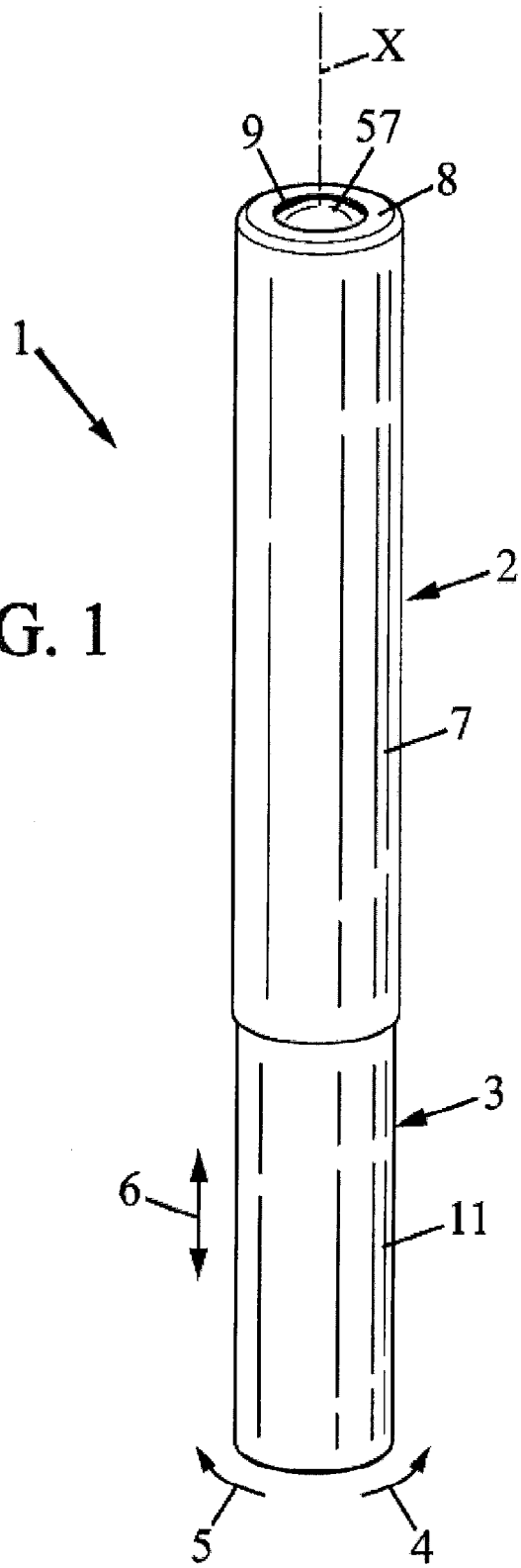
FIG. 1 is a general perspective view of an applicator device in a first embodiment of the invention, in the stored position.

FIG. 1 represents an applicator device 1 for a product, in this example mascara, according to a first embodiment of the invention. This applicator device extends longitudinally along a central axis X and more specifically is in a substantially cylindrical form centered on this axis X.

The applicator device comprises an external body 2 and a base 3 which is mounted so as to rotate relative to the external body 2 about the axis X, in first and second angular directions 4, 5, said base also able to slide parallel to the axis X inside the external body 2, in the direction of the double arrow 6, as will be explained in more detail below.

Figure 2:
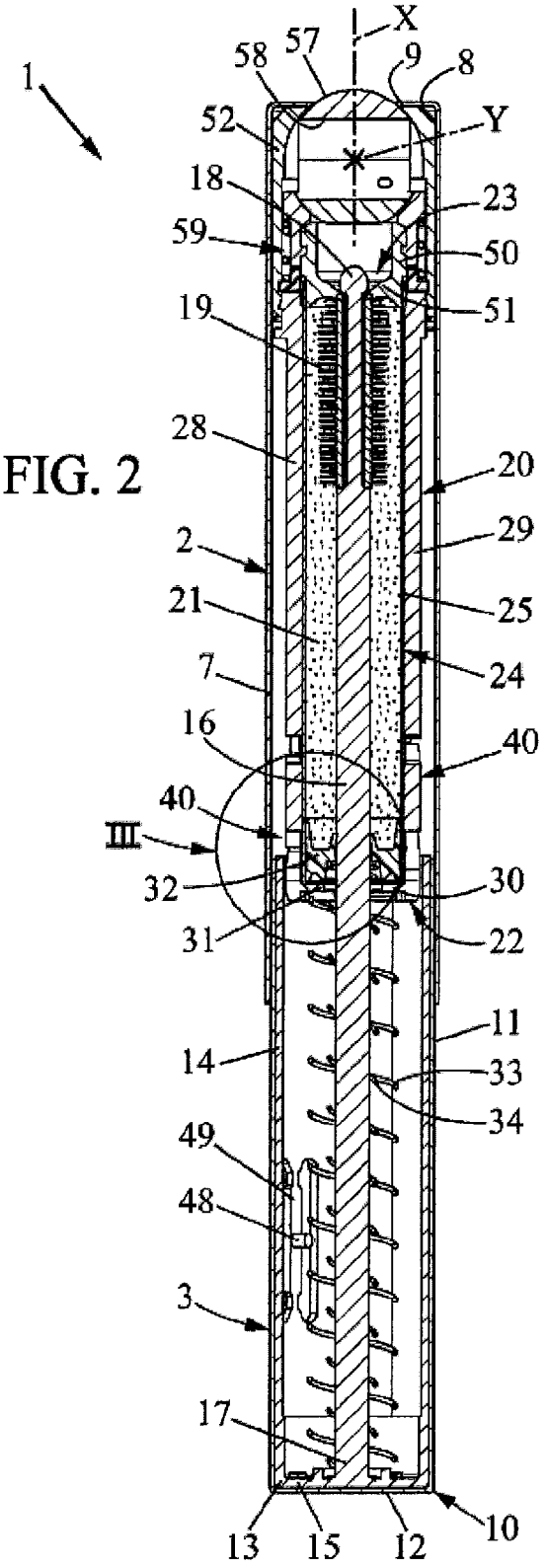
FIG. 2 is an axial cross-sectional view along the central axis X of the applicator device of FIG. 1, in the stored position.
Figure 4:
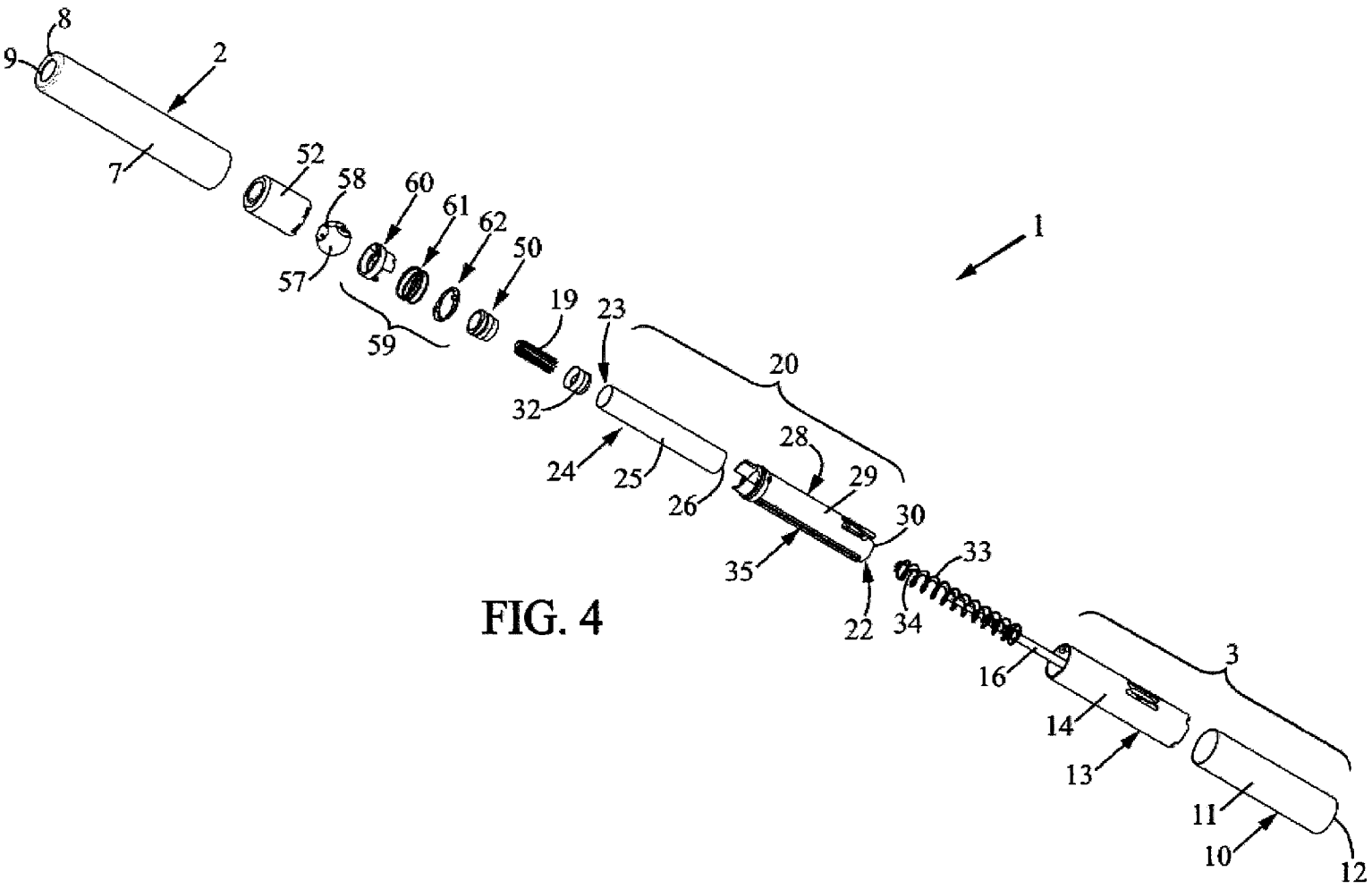
FIG. 4 is an exploded perspective view of the applicator device of FIG. 1, FIGS. 5 and 6 are detailed exploded perspective views, showing a portion of the base and a portion of the reservoir of the applicator device of FIG. 1, viewed from two different angles.
Figure 5:
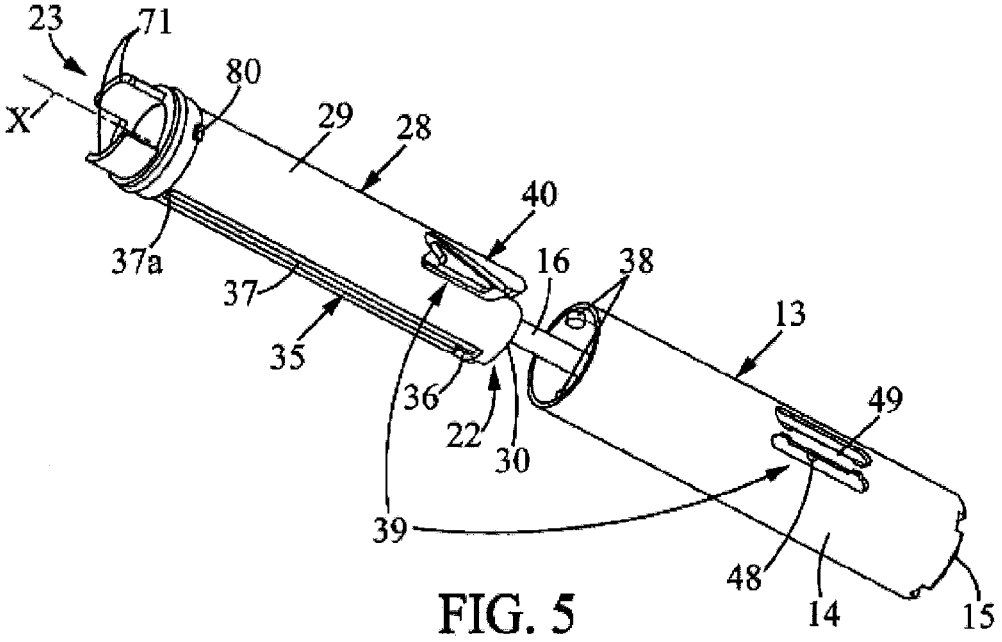

As represented in more detail in FIGS. 2 and 4, the external body 2 can for example be a drawn part made of aluminum, light alloy, brass, or other, comprising a cylindrical side wall 7 centered on the X axis, which extends between a lower open end and an upper end which forms an inner edge 8 delimiting a central opening 9 (expressions such as "upper", "lower" "top", "bottom", as used in the present document are only provided for easier comprehension and refer to the common position for storing and handling the applicator device 1, meaning with the central axis X being vertical and the opening 9 towards the top).

The base 3 can be made either as a single part, or preferably as two parts such as in the example considered here where said base 3 comprises:

- a drawn outer shell 10 of aluminum, light alloy, brass, or other, this outer shell comprising: a cylindrical side wall 11 centered on the axis X, which extends between an upper open end that fits inside the lower open end of the external body 2; and a bottom 12,
- and an inner guide 13, made for example of molded plastic or other material such as polyoxymethylene (POM), which fits inside the shell 10 without play and is solidly connected to it by any known means, for example by glue, this inner guide 13 comprising a cylindrical side wall 14 centered on the axis X and fitting inside the side wall 11 of the shell 10, this side wall 14 extending between an open upper end near the upper end of the shell 10 and a bottom 15 placed against the bottom 12 of the outer shell 10.

A cylindrical rod 16 is also solidly connected to the base 3. This rod 16 may for example be made of the same plastic part as the inside tube 13 of the base, said rod 16 extending longitudinally along the axis X between a lower end 17 solidly connected to the base 15 and integral with it, and an upper free end 18 which is placed inside the external body 2.

Near the free end 18, the rod 16 comprises an applicator head 19, for example a brush, which may be made as one part with the applicator head 16 or may be connected to it for example by interlocking them, as is the case in the example considered here.

The applicator device additionally comprises a reservoir 20 which is filled with mascara 21 to be applied and which extends longitudinally along the axis X between a lower proximal end 22 which is closed so as to seal the mascara within and an upper distal end 23 which is axially open.

The reservoir 20 can be made as a single part if necessary, but in the example considered here it is preferably made as two parts:

- an inner sleeve 24 made for example of aluminum or stainless steel, this inner sleeve comprising a cylindrical side wall 25 which extends between an upper open end and a lower bottom 26 pierced by a central opening 27 (see FIGS. 2 and 3),
- and a body 28 of plastic or other material, for example polyethylene (PE), which fits onto the outside of the sleeve 24 and which is solidly connected to it by glue or any other known means, this body 28 comprising a cylindrical side wall 29, which extends longitudinally along the axis X between an upper open end at the distal end 23 of the reservoir and a lower bottom 30 which delimits a central opening 31 that corresponds with the central opening 27 of the inner sleeve 24.

Figure 3:
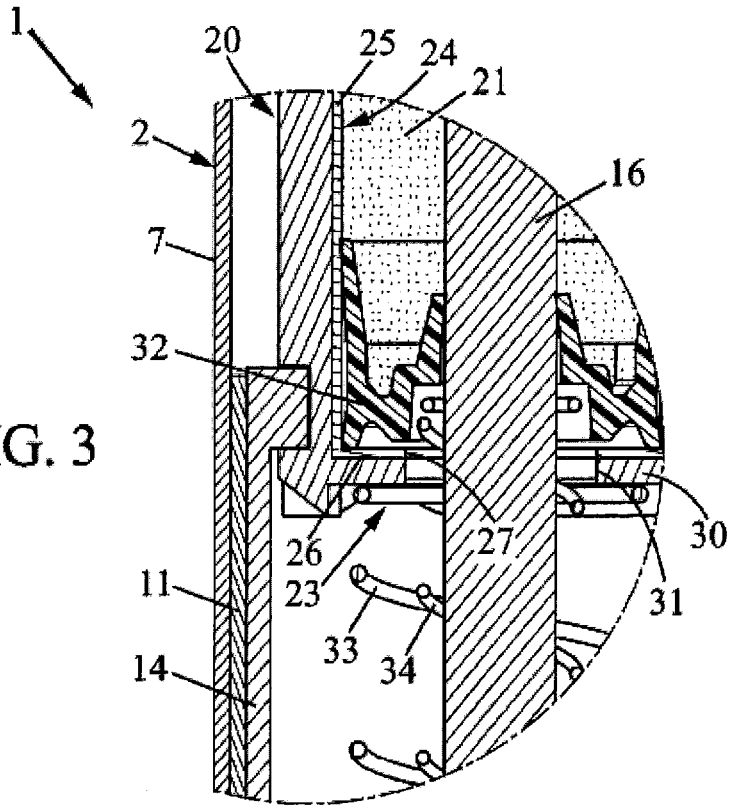
FIG. 3 is a detailed view of III from FIG. 2 along an axial cross-section, showing a portion of the applicator device of FIG. 2 in a different axial cross-sectional plane than the one in FIG. 2.

As represented in FIGS. 2 to 4, a piston 32, made for example of plastic (polyethylene (PE), high density polyethylene (HDPE), or other), slides within the cylindrical side wall 25 of the sleeve 24 while maintaining the seal, this piston 32 also sliding on the rod 16 along the axis X while maintaining the seal.

The applicator device additionally comprises a reservoir spring 33 that is a coil spring. Said spring wraps around the rod 16 and is assembled between the bottom 15 of the guide 13 and the bottom 30 of the body of the reservoir, biasing the reservoir 20 and the base 3 to move apart from each other.

In addition, a piston spring 34, for example of stainless steel 301, which is again a coil spring that wraps around the rod 16, is arranged inside the reservoir spring 33. This piston spring presses against the bottom 15 of the guide 13 and against the piston 32, passing through the opening 31 in the bottom of the body of the reservoir and the opening 27 in the bottom of the sleeve of the reservoir. This piston spring 34 is only slightly compressed when the applicator device is in the storage position, or is not at all compressed if the piston is in its high position in the reservoir.

As represented in more detail in FIGS. 5 to 8, the base 3 is connected to the reservoir 20 by an L-shaped track 35 which, in the example considered here, consists of a groove or slot arranged in the body 28 of the reservoir 20, and which comprises:

- an orthoradial arm 36 extending angularly around the axis X, in the first angular direction 4 from one end 36*a* to an axial arm 37, this axial arm 37 extending upwards from the orthoradial arm 36 to an upper end 37*a*. In the example represented in the drawings, the body 28 of the reservoir 20 comprises two tracks 35 which are diametrically opposite relative to the axis X, but it would be possible to use only one track 35.

Engaging with each track 35 is a pin 38 projecting radially inwards from the guide 14 near its upper end. In the storage position of the applicator device 1, the pins 38 are arranged at the level of the ends 36*a* of the orthoradial arms 36 of the tracks 35.

The base 3 cooperates with the reservoir 20 by a retention mechanism 39 which is also clearly visible in FIGS. 5 to 8 and which is suitable for selectively retaining the base in the utilization position of the applicator device, as will be explained below, or releasing this base. This retention mechanism 39 is adapted here to lock the base in place automatically when it reaches a final position corresponding to the utilization position, after upwards axial displacement of said base 3 as the pins 38 slide in the axial arms 37 of the tracks 35, and said retention mechanism is a two-state mechanism adapted to release the base when a user again applies upward force to the base 3 once it has been locked in the utilization position of the applicator device.

More specifically, the retention mechanism 39 may comprise a winding path 40 arranged in the side wall 29 of the body 28 of the reservoir.

In a known manner, this winding path can be in the form of a substantially heart-shaped groove, which has:

- an axial opening 41 leading downwards,
- a first arm 42 arranged facing the opening 41 and angling upward from the opening 41,
- an upper V-shaped portion comprising:
  - a second arm 43 which is connected to the upper end of the first arm 42 and which has an upper rounded edge where it connects with the upper end of the first arm 42,
  - a third arm 44 which angles upward in the opposite direction than the first and second arms 43, starting from the point 45 of the V, this third arm 44 having an upper edge which covers the point 45 of the V in the axial direction X, and a fourth arm 46 which said third arm 44 opens into via a relief variation 47, said fourth arm 46 extending at a downward angle to meet the first arm 42 near the opening 41.

The guide 13 of the base additionally comprises a pin 48 which is preferably supported by an elastic strip 49 arranged in the side wall 14 of the guide 13, this pin 48 being adapted to enter the winding path 40 when the pins 38 of the inner guide 13 slide in the axial arms 37 of the tracks 35: the pin 48 follows the first arm 42 of the winding path while the user is pressing axially upwards on the base 3, then said pin 48 follows the second arm 43 and drops into the point 45 of the V of the winding path when the user releases the base 3, which retains the base 3 in the utilization position.

When the user once again presses upwards on the base 3, this pressure first causes the pin 48 of the inner guide 13 to move into the third arm 44 of the winding path until the pin 48 reaches the upper end of the fourth arm 46 and is kept there by the presence of the relief variation 47; when the user releases the pressure, the pin 48 then travels back down the fourth arm 46 of the winding path and exits by the opening 41 so that the base 3 can return to its initial position due to the biasing of the spring of the reservoir 33.

It is possible for the body of the reservoir to comprise two winding paths 40, and for the guide 13 to comprise two pins 48 respectively supported by two strips 49, these pins 48 each cooperating with one of the winding paths 40.

As represented in FIGS. 9 to 12, the reservoir 20 is conventionally equipped at its distal end with a wringer 50 made for example of an elastomer, which is attached to the inside of the side wall 25 of the sleeve of the reservoir by interlocking with the plug valve control member 60 as explained in more detail below. This wringer 50 comprises an inside annular lip 51, which is adapted to wring the applicator head 19 and/or the rod 16 as it exits the reservoir and which is also arranged to come into radial sealed contact with the free end 18 of the rod 16, beyond the applicator head 19. When the applicator head 19 has exited the reservoir, the lip 51 of the wringer is also adapted to establish a seal with the portion of the applicator rod 16 located below the applicator head 19.

At the upper end of the external body 2, a cap 52 is attached to the inside of the external body 2, meaning at the distal end of the reservoir. This cap 52 comprises a sealing lip 53 which projects radially at the edge 8 of the external body 2, and said cap 52 is axially traversed along the axis X by a central passage 54. The cap 52 may be made of polypropylene (PP) or high density polyethylene (HDPE).

Oblong pockets 55 extending along the axis X are arranged within the inside of the cap 52. These accept the studs 56 of a spherical plug valve 57 and allow said spherical plug valve to pivot on a transverse axis of rotation Y that is perpendicular to the central axis X. The spherical plug valve comprises a cylindrical central passage 58 that extends along an axis perpendicular to the transverse axis Y, the axis of the central passage also being perpendicular to the central axis X when the applicator device is in the storage position.

The spherical plug valve 57 is controlled by a control device 59 which comprises:

a plug valve control member 60, a plug valve coil spring 61, for example of 316L stainless steel, centered on axis X, which biases the plug valve control member upwards towards the spherical plug valve 57, and a supporting ring 62 which presses against the distal end of the reservoir 20, the plug valve spring being placed between the plug valve control member 60 and the supporting ring 62 where it biases them away from each other along axis X.

The plug valve control member 60 comprises a pin 63 which is engaged in a groove 64 created on the exterior of the spherical plug valve, this groove 64 being angled so that a pivoting of the plug valve control member 60 about the axis X causes the spherical plug valve 57 to pivot on the transverse axis Y. In the example represented, the spherical plug valve 57 comprises two grooves 64 of identical shape and diametrically opposite, only one of them used by the pin 63. This arrangement facilitates assembly of the spherical plug valve, as it eliminates the need to orient said spherical plug valve by rotating it on the transverse axis Y during assembly.

The control member 60 comprises a supporting part 65 in the form of a sphere section, which presses up against the spherical plug valve, biasing said spherical plug valve towards the sealing lip 53 of the cap 52 such that the spherical plug valve 57 covers and seals the outlet of the applicator device 1 when said spherical plug valve is in its closed position. This sealing pressure of the spherical plug valve against the sealing lip 53 is enabled by the assembly with axial play of the studs 56 in the oblong pockets 55 of the cap. The spherical plug valve 57 may advantageously be made with one of the following materials: acrylonitryl-butadiene-styrene (ABS), polyoxymethylene (POM), or polybutylene-terephthalate (PBT).

In the example considered here, the plug valve control member 60 is also rotationally attached to the reservoir 20. For this purpose, the plug valve control member 60 can, for example, interlock with the reservoir 20 to cooperate with it in order to establish this rotational attachment. In the example considered here, the plug valve control member 60 comprises two tabs 66 extending towards the reservoir 20, said tabs 66 possibly each presenting, on their end face, a notch 67 which fits together with a projecting pin 68 arranged on the upper face of the supporting ring 62, such that the plug valve control member 60 and the supporting ring 62 are rotationally attached. The tabs 66 of the plug valve control member 60 are separated from each other by axial notches 69 which accommodate tabs 71 that are part of the body 28 of the reservoir and that project axially upwards from the upper end of said body, passing through radial notches 70 arranged in the interior of the supporting ring 62.

The reservoir 20 may be retained in the cap 52 by, for example, an external annular rib 72 formed at the distal end of the body 28 of the reservoir 20, said rib 72 snapping together with an internal annular rib 73 arranged in the cap 52. The reservoir 20 can thus only rotate about the axis X relative to the cap 52, and cannot move axially relative to said cap.

Figure 9:
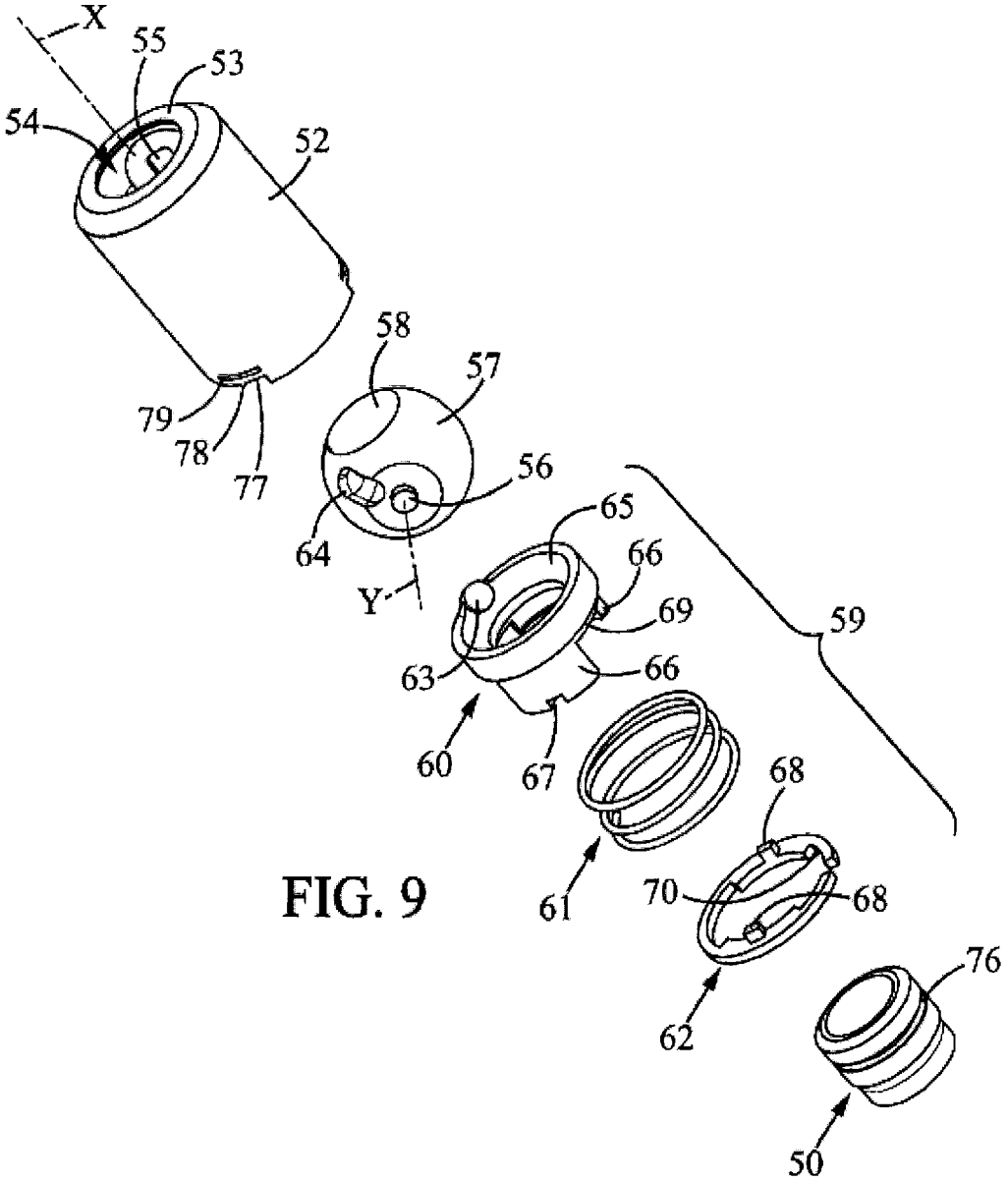
Figure 10:
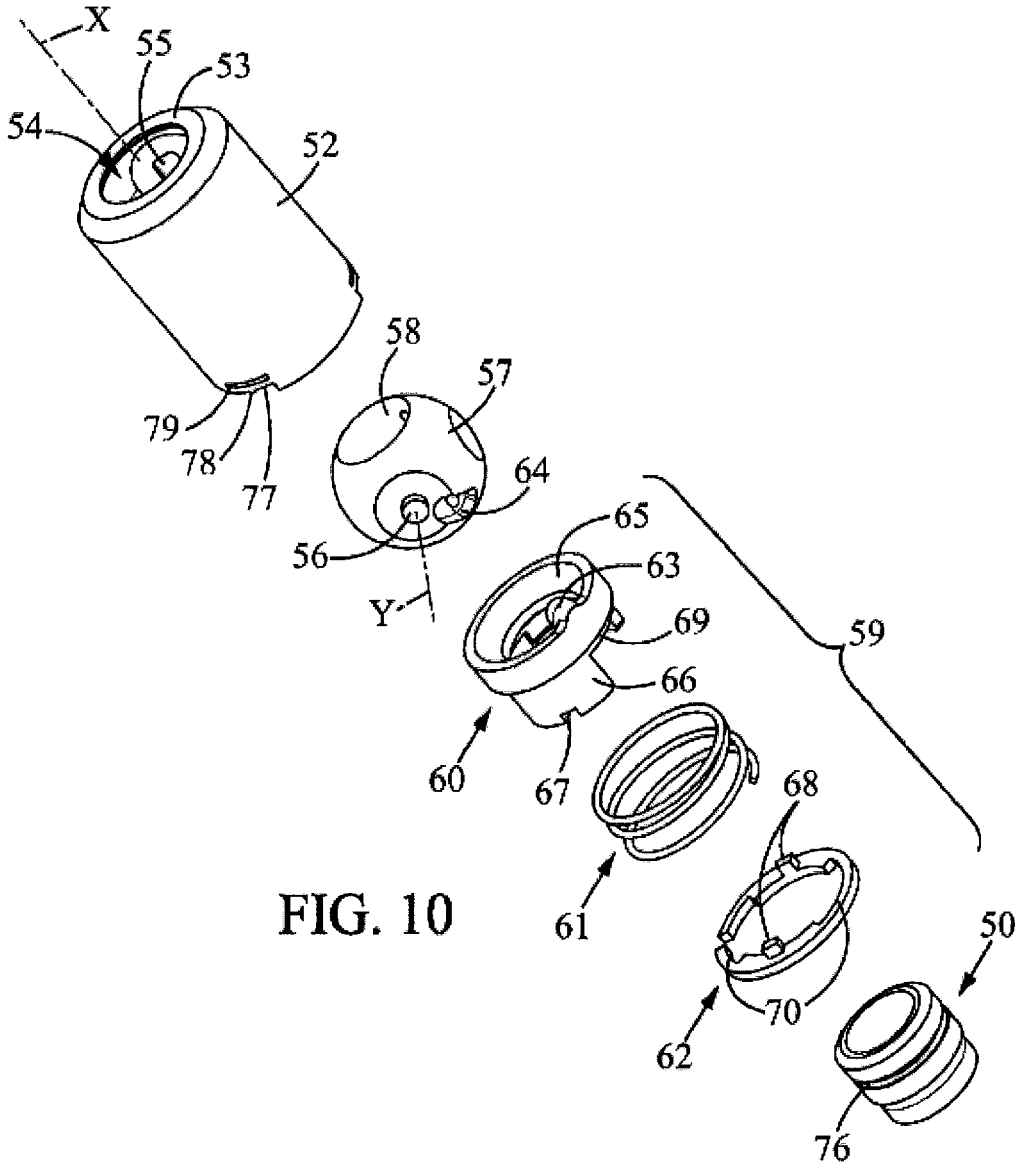
Figure 11:
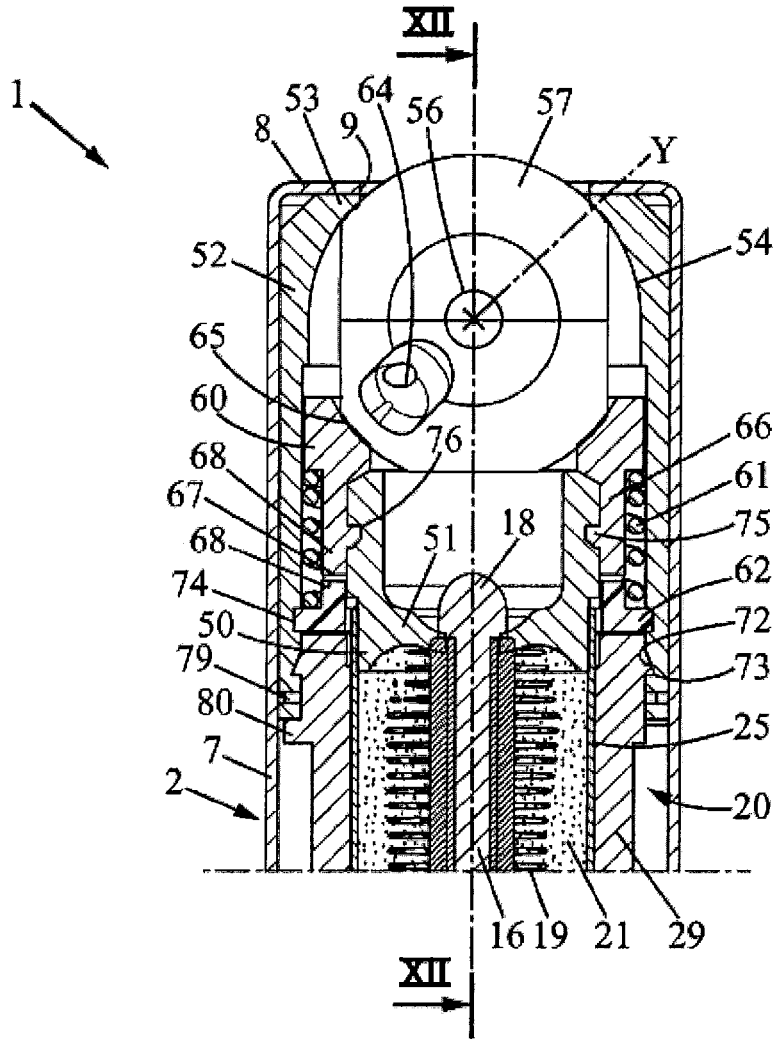
FIG. 11 is a detailed view along an axial cross-section of the upper end of the applicator device of FIG. 1, without cross-sectioning the spherical plug valve.
Figure 12:
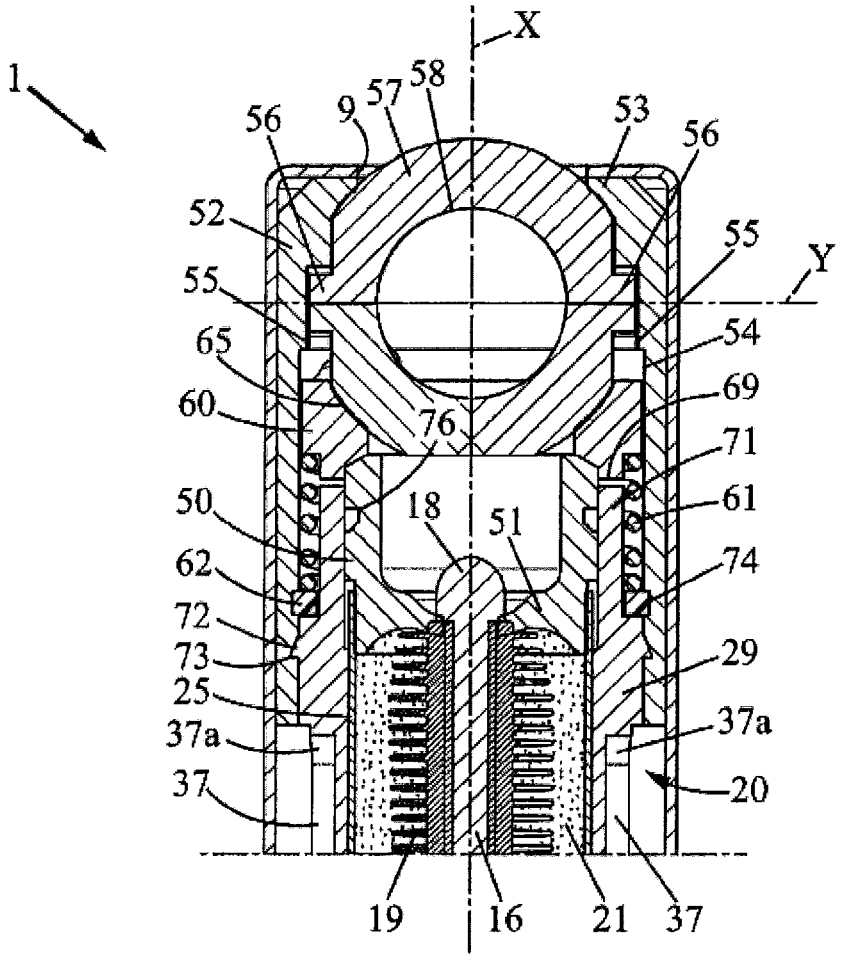
FIG. 12 is a cross-sectional view along line XII-XII in FIG. 11, with cross-sectioning of the spherical plug valve.

In addition, it is possible to have the supporting ring 62 interlock with an internal annular groove 74 created in the inside of the cap 52. To facilitate this interlocking, the supporting ring 62 may possibly have a slit as can be seen in FIGS. 9 and 10, to allow it to yield elastically.

Lastly, the tabs 68 of the plug valve control member 60 may possibly be equipped with teeth or internal ribs 75 which enter into an annular groove 76 arranged on the exterior of the wringer 50. The lower edge of the cap 52 can be equipped with one or more notches 77 axially directed towards the base 3 (see FIG. 17), said notches extending angularly between two ends, with downward-projecting catches 78 (one pair of catches 78 per notch 77). Slots or other recesses 79 may be arranged in the side wall of the cap 52 above these projecting catches 78 to allow said catches to flatten elastically during the passage of a pin 80 projecting radially at the distal end of the body 28 of the reservoir and moving within the corresponding notch 77, thus defining the extent of the angular movement the reservoir 20 is allowed relative to the external body 2 and to the cap 52. In the specific example considered here, there are two notches 77 and two projecting pins 80. Thus each pair of catches 78 provides a user-evident indication of the start and end of the opening process and also fulfills a return-prevention function which prevents an accidental opening or closing of the plug valve.

The device in the first embodiment of the invention operates as follows.

Figure 13:
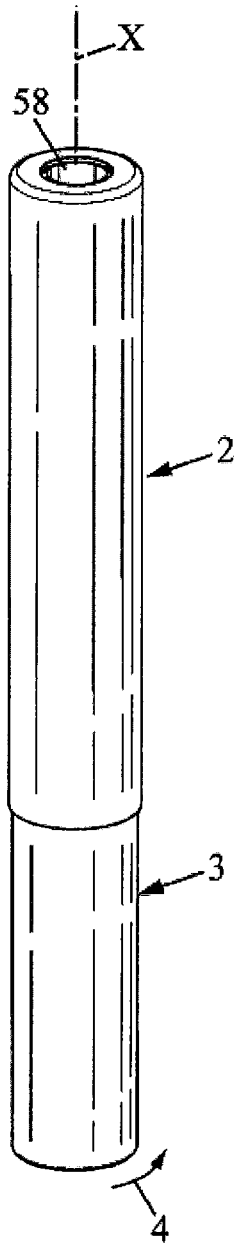
FIG. 13 is a perspective view of the applicator device of FIG. 1, the plug valve being in the open position.
Figure 14:
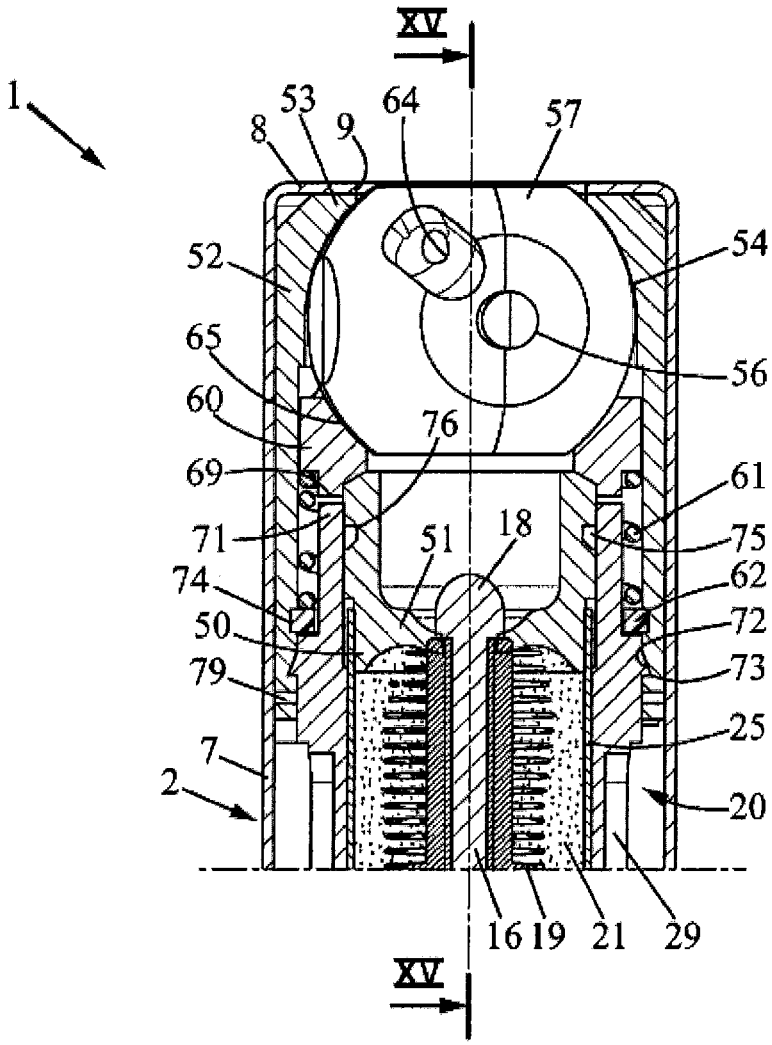
FIG. 14 is an axial cross-sectional view of the upper end of the applicator device of FIG. 13, the plug valve being in the open position, but without cross-sectioning the spherical plug valve.
Figure 15:
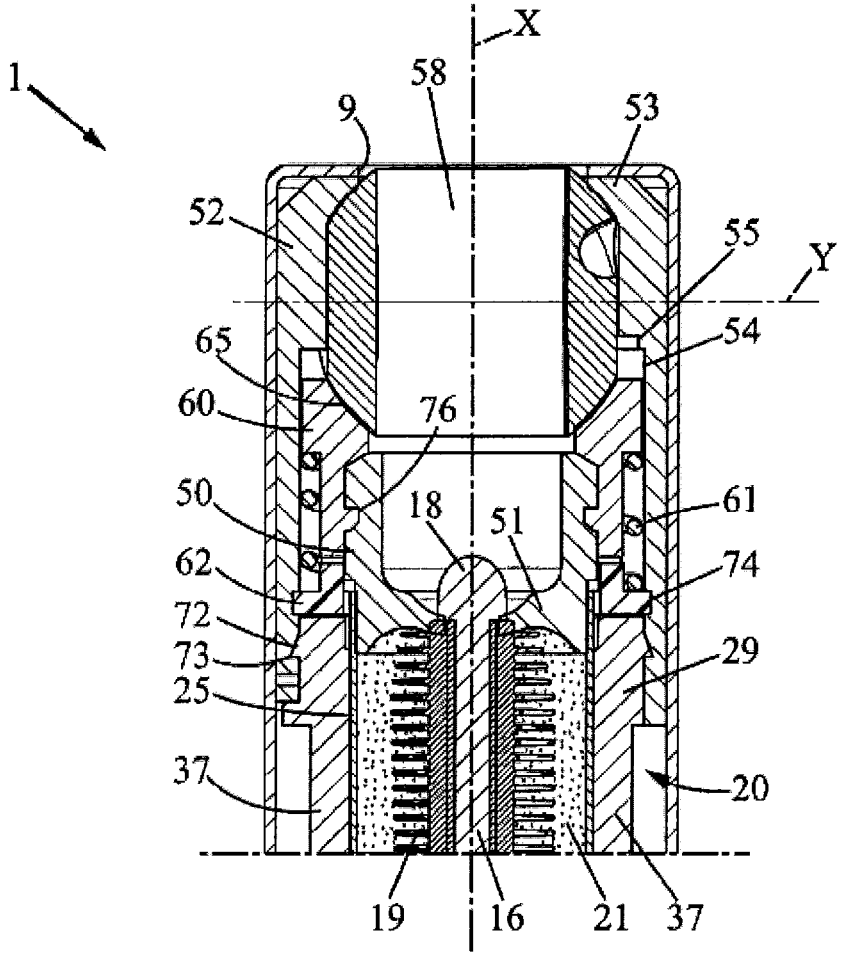
FIG. 15 is a cross-sectional view along line XV-XV in FIG. 14, with cross-sectioning of the spherical plug valve.
Figure 16:
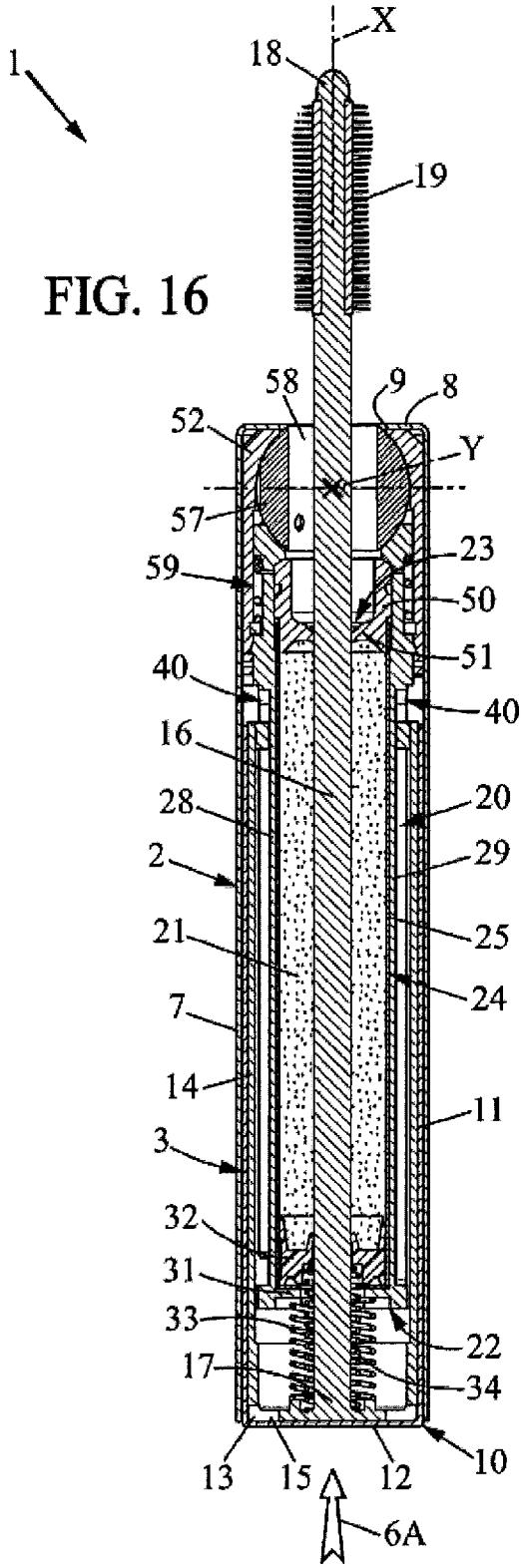
FIG. 16 is an axial cross-sectional view showing the applicator device of FIG. 1 in the utilization position.
Figure 17:
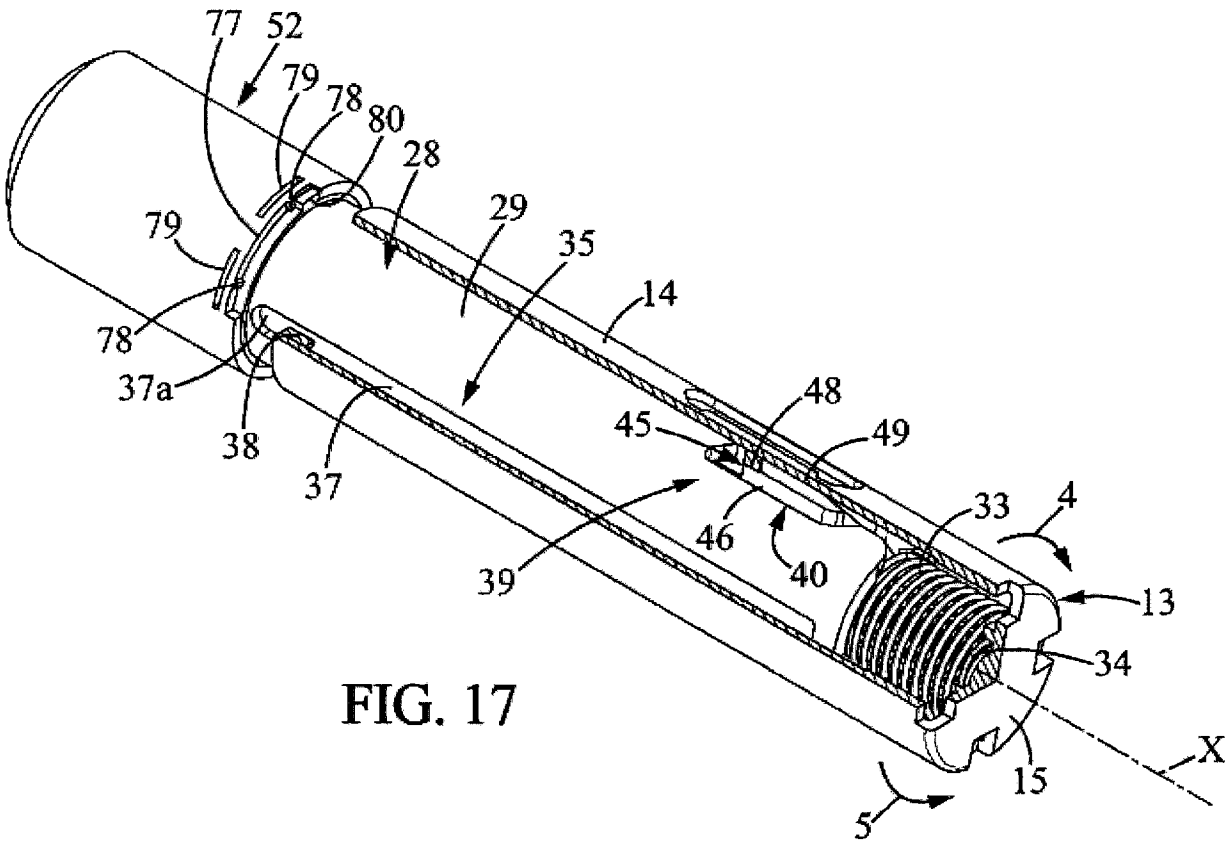
FIG. 17 is a cutaway perspective view, showing the base guide and the reservoir body of the applicator device of FIG. 1, in the utilization position.

Starting from the storage position represented in FIGS. 1 to 12, a user wanting to make use of the applicator device moves the base 3 relative to the external body 2 along an actuating path which comprises:

- a first path section consisting of a rotation in the first angular direction 4, about the axis X, from the initial storage position to an intermediate position (FIGS. 13 to 15) where the spherical plug valve 57 is in the open position while the rod 16 is still in the retracted position,
- then a second path section, in which the base 3 slides along the axis X in the direction of the external body 2 in direction 6A, causing the applicator head 19 to exit through the central passage 58 of the spherical plug valve (FIGS. 16 and 17).

Figure 6:
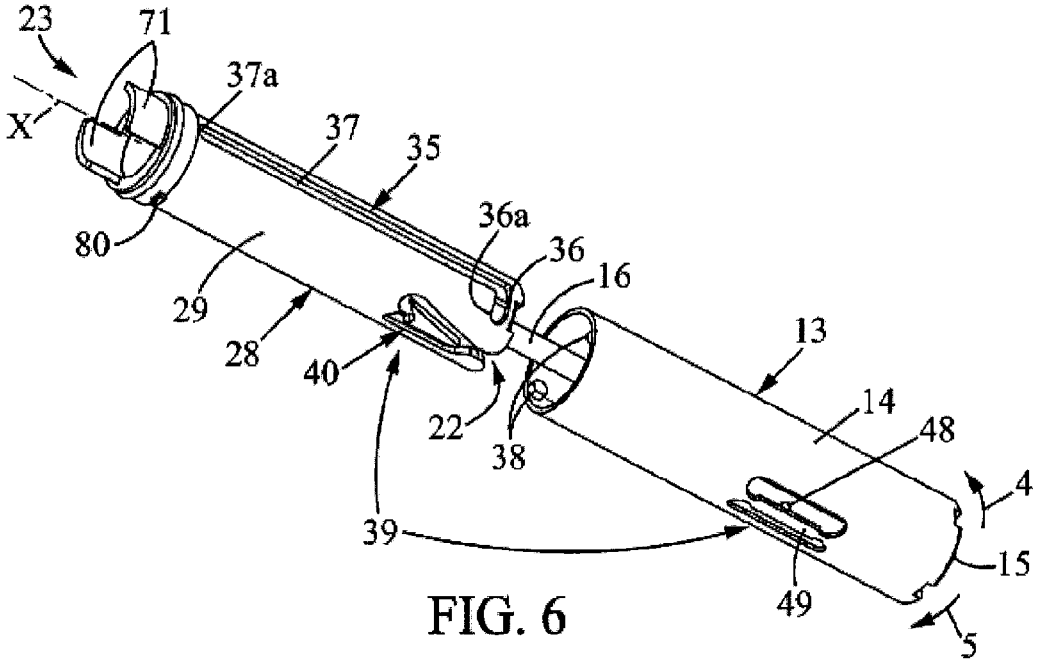
Figure 7:
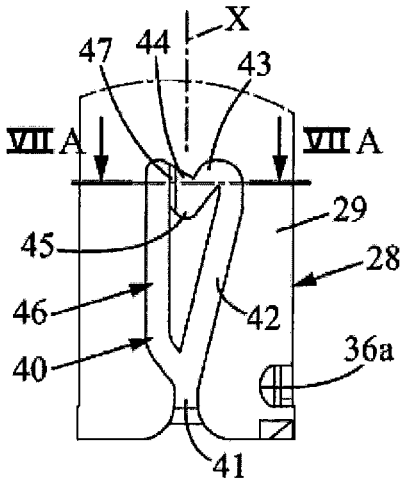
FIG. 7 is a side view showing the lower portion of the reservoir of the applicator device of FIG. 1.
Figure 7A:
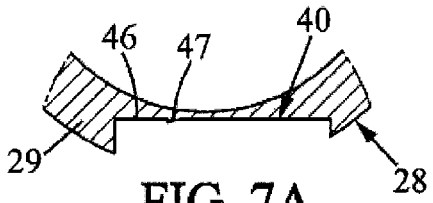
FIG. 7A is a cross-sectional view along line VIIA-VIIA of FIG. 7.
Figure 8:
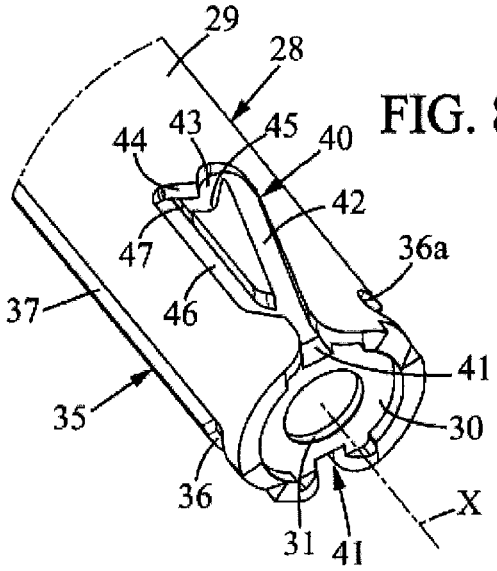
FIG. 8 is a perspective view showing the lower portion of the reservoir of the applicator device of FIG. 1, FIGS. 9 and 10 are detailed exploded perspective views showing the cap, the plug valve, and the plug valve control device of the applicator device of FIG. 1, these elements being viewed from two different angles.

In the first path section, where the user rotates the base 3 about the axis X in the first angular direction 4 relative to the external body 2 (FIGS. 13 to 15), the base 3 first rotates alone because of its lost motion assembly relative to the body 28 of the reservoir 20: during this first portion of the first path section, the pins 38 of the inner guide 13 advance in the first angular direction 4 from the end 36*a* of the orthoradial arm 36 of the track 35, to the opposite end of this orthoradial arm 36 which communicates with the axial arm 37 of the track 35 (see FIG. 6).

In the subsequent rotational motion of the base 3, the base 3 rotates the reservoir 20 along with it, by means of the pins 38 of the inner guide 13, such that the pins 80 of the body 28 of the reservoir are each advanced from one end to the other of the corresponding notch 77 of the cap 52. By leaving one end of this notch 77 and reaching the other end of this notch 77, the pin 80 must move beyond the catches 78 of the notch 77, which flatten due to the yielding of the strip, which is part of the cap material, separating the catch 78 from the corresponding slot 79 (the final position of the pin 80 in the notch 77 being visible in FIG. 17 which corresponds to the utilization position of the applicator device).

The presence of catches 78 establishes set points preferably associated with a "click" sound that guides the user in utilizing the applicator device. When the user has rotated the base 3 in the first angular direction 4 until the pins 80 of the guide 13 press against the notches 77 of the cap, this rotational motion of the reservoir 20 has also caused a rotation of the control device 59 of the plug valve, during which the pin 63 of the plug valve control member 60 slides in the corresponding groove 64 of the plug valve, forcing the plug valve to pivot on the axis Y in the open position represented in FIGS. 13 to 15 in which the central passage 58 of the plug valve is oriented along the X axis.

In the second path section of the base 3, the user axially pushes the base 3 within the external body 2 in the direction 6A of FIG. 16, all the way to the exited position of the rod 16 where the applicator head 19 is extended beyond the external body 2 and where the rod 16 traverses the central passage 58 of the spherical plug valve and the lip 51 of the wringer 50 establishes a seal with the rod 16 before the applicator head 19. In this position, the piston spring 34 is compressed and upwardly biases the piston 32, meaning towards the wringer 50, which allows the reservoir 20 to always be filled with mascara 21 between the piston 32 and the wringer 50 with substantially no air pockets, in spite of the progressive removal of mascara 21 by the applicator head 19 during successive utilizations of the applicator device. This guarantees that the applicator head 19 is always immersed in product 21 when the rod 16 is in the retracted position, and prevents the mascara 21 from drying out.

In the utilization position, as represented in FIG. 17, the retention device 39 maintains the base 3 in its final position, close to the cap 52, by the engagement of the pin 48 of the inner guide 13 with the point 45 of the V of the winding path 40. In this position, some axial play remains between each pin 38 and the upper end 37*a* of the axial arm 37 of the corresponding track 35, which then allows the user, after utilizing the applicator device, to return the applicator device 1 to the storage position by first pushing the base 3 upwards in order to release the pin 48 which then exits the winding path, while the reservoir spring 33 pushes the base 3 downwards as the pins 38 of the inner guide 13 slide to the lower end of the axial arm 37 of the corresponding track 35; then the user pivots the base 3 in the second angular direction 5, opposite the first angular direction, which:

- firstly advances the pins 38 of the guide 13 within the first arm 36 of the correspondent track 35, all the way to the first end 36*a* of the orthoradial arm 36,
- then drives the body 28 of the reservoir in the second angular direction 5 which closes the spherical plug valve 57 while the pins 80 of the guide 13 are advanced in the angular direction 5 within their respective notches 77 until they reach the stop position, corresponding to the storage position of the device.

B. Second Embodiment of the Invention

Figure 18:
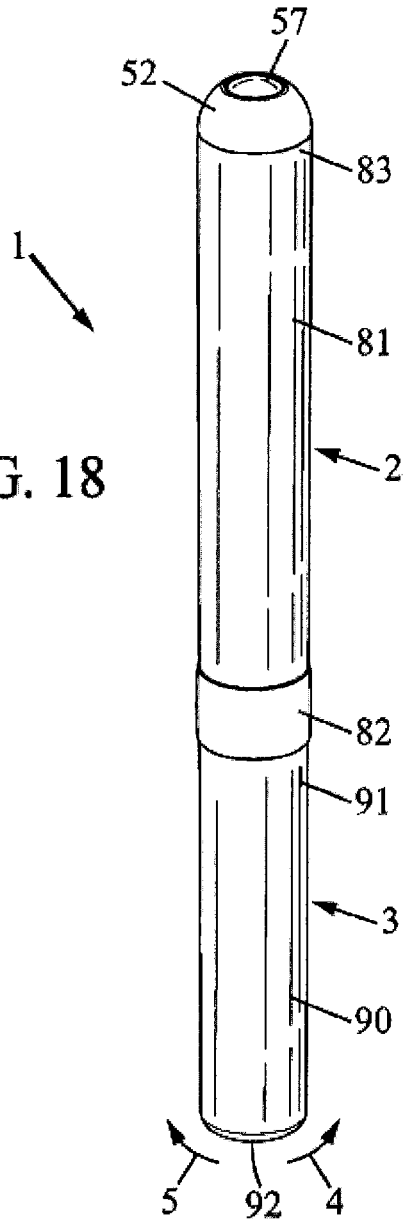
FIG. 18 is a perspective view of an applicator device according to a second embodiment of the invention, in the stored position.

In the second embodiment of the invention, represented in FIGS. 18 to 33, the applicator device 1, visible in FIG. 18 in the storage position, extends longitudinally along the central axis X and comprises, as above, an external body 2 and a base 3. However, this base 3 is not axially movable relative to the external body 2, but solely rotatable about axis X in the abovementioned first and second angular directions 4, 5.

Figure 19:
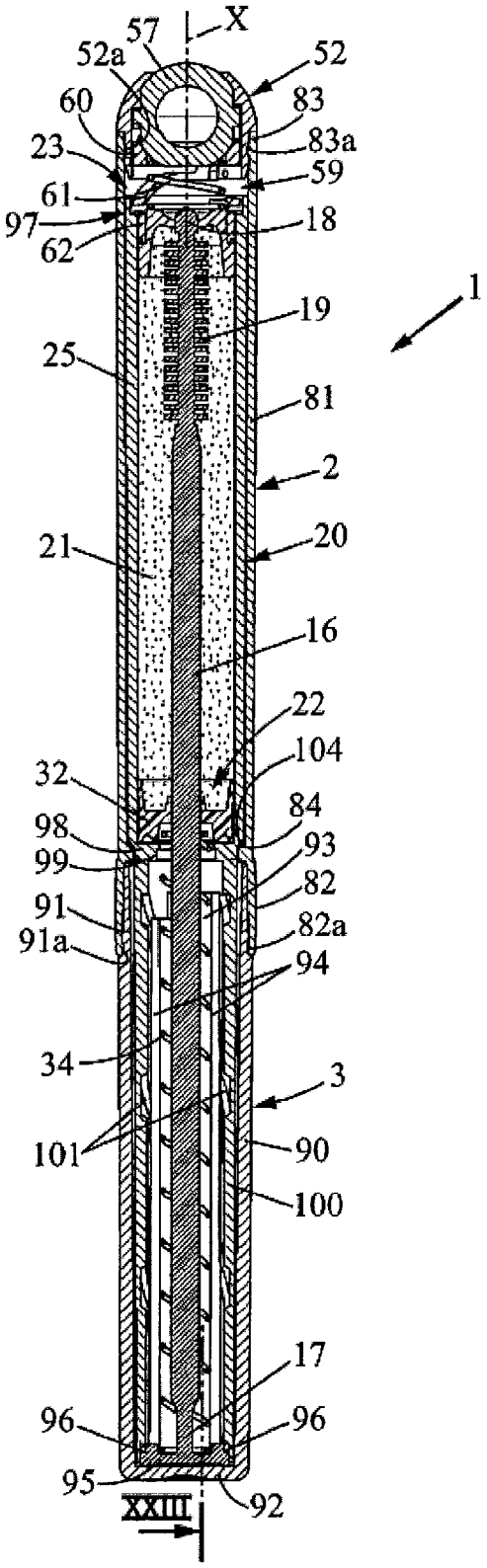
FIG. 19 is an axial cross-sectional view of the applicator device of FIG. 18, in the stored position.
Figure 20:
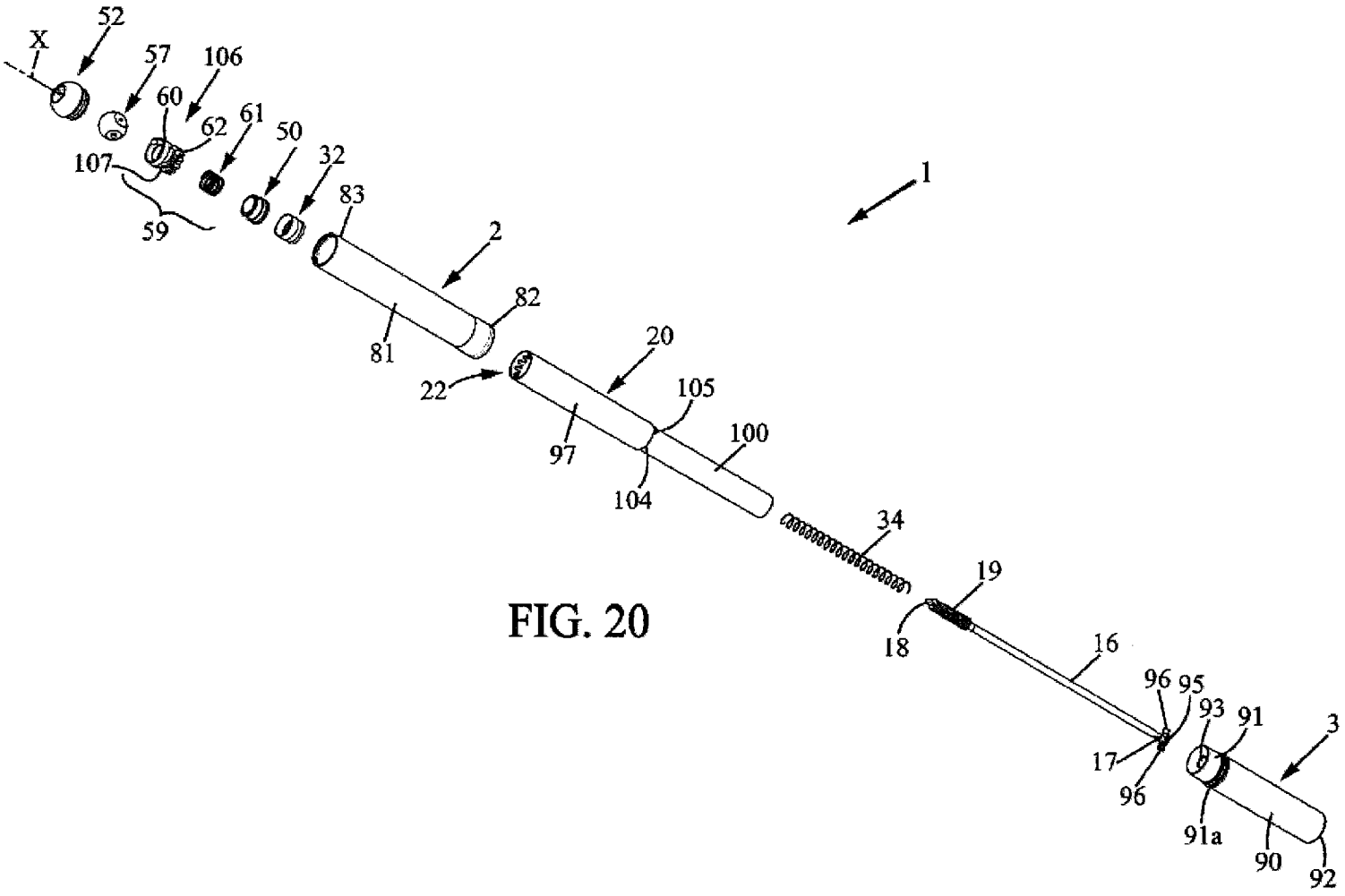
FIG. 20 is an exploded perspective view of the applicator device of FIG. 18.

As represented in more detail in FIGS. 19 and 20, the external body 2 may for example be a part of molded plastic or other material, comprising a cylindrical side wall 81 centered on the axis X, which extends between an open lower end 82 and an open upper end 83.

Figure 25:
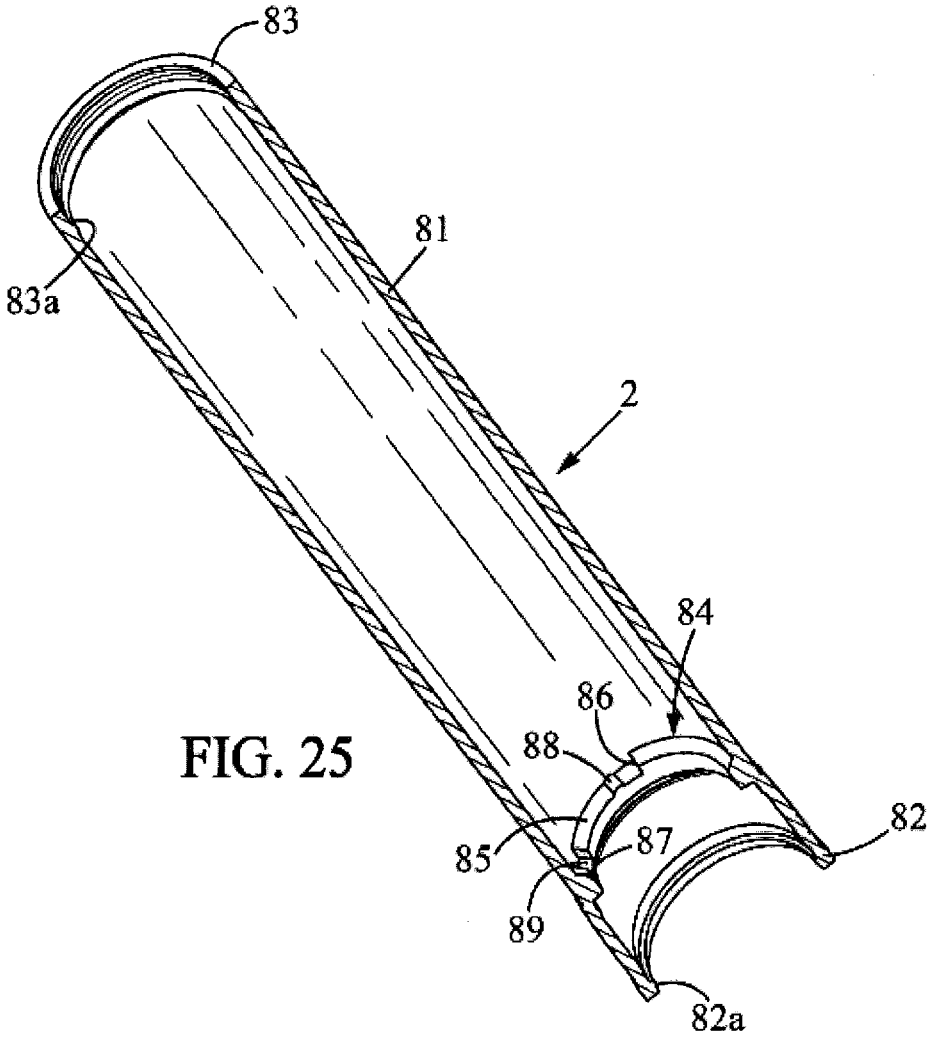
FIG. 25 is an axial cross-sectional perspective view showing the external body of the applicator device of FIG. 18, FIGS. 26 and 27 are exploded perspective views showing the cap, plug valve, and plug valve control member of the applicator device of FIG. 18, these elements being viewed from two different angles.

As represented in FIG. 25, the external body 2 comprises coupling means which allow selectively coupling or decoupling the external body 2 and the reservoir 20 that it contains. In the specific example considered here, these coupling means comprise a notch 85 arranged in an inside shoulder 84 formed in the side wall 81, near its lower end 82. This notch 85 extends angularly between a first stop face 86 and a second stop face 87. A projecting catch 88 can be formed within the notch 85 if necessary, near its first stop face 86, while an indentation 89 is axially formed in the shoulder 84, deeper than the rest of the notch 85, at the second stop face 87.

The base 3 may be, for example, in the form of a part of molded plastic or other material, and comprises a cylindrical side wall 90 centered on the axis X, which extends between an open upper end 91, fitting into the open lower end of the external body 2, and a bottom 92.

The base 3 is rotatably mounted relative to the body 2 by any known means. In the example considered here, the base 3 is snapped onto the body 2, for example by elastically interlocking an annular rib 82*a* formed at the lower end 82 of the side wall of the external body 2, with an external annular groove 91*a* formed near the upper end 91 of the side wall of the base 3.

Figure 21:
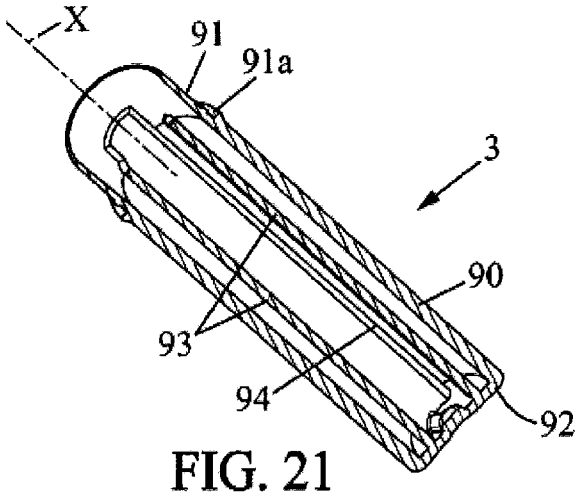
FIG. 21 is an axial cross-sectional perspective view showing the base of the applicator device of FIG. 18.

As one can see in FIGS. 19, 20 and 21, the base 3 may additionally comprise internal fins 93 which extend axially along the axis X from the bottom 92 of the base 3 to near the upper end 91 of its side wall, inside said side wall 90. These fins 93, which may advantageously be shaped from the same piece as the base 3, may for example be two in number and may each be in the form of a cylinder segment centered on the axis X, these fins 93 being respectively separated by two axial slits 94 parallel to the axis X and extending for the entire length of said fins 93.

As in the first embodiment, the applicator device 1 additionally comprises a cylindrical rod 16 (see FIGS. 19 and 20) which may, for example, be in the form of a molded plastic piece extending longitudinally along the axis X between a lower end 17 and a free upper end 18 which is placed inside the external body 2. Unlike the first embodiment of the invention, the lower end 17 of the rod 16 is not entirely integral with the base 3: here the rod 16 is a part separate from the base 3 and the lower end of said rod comprises a rod foot 95 forming, for example, a transverse bar perpendicular to the central axis X, its two lateral ends forming side posts 96 which are respectively and axially guided in the two axial slots 94 of the base 3.

Near the free end 18, the rod 16 comprises an applicator head 19, for example a brush, which may be made as one piece with the applicator rod 16, the case in the example considered here, or may be connected to it, for example by interlocking the pieces.

The applicator device additionally comprises a reservoir 20 which is filled with mascara 21 to be applied and which extends longitudinally along the axis X between a lower proximal end 22 sealed in a mascara-tight manner and an upper distal end 23 which is axially open.

The reservoir 20 may for example be in the form of a piece of plastic material comprising a cylindrical side wall 25 which extends between an open upper end 97 forming said distal end and a proximal bottom 98 pierced with a central opening 99 (see FIGS. 19 and 22 to 24).

The reservoir 20 is further extended in the direction of the central axis X, beyond its proximal end 22, by a conveying tube 100 which may advantageously be formed of the same piece as the reservoir 20 and which extends to an open lower end.

Inside the tube are two parallel helical grooves 101 centered on the axis X, which accommodate the side posts 96 of the rod foot 95 described above. In addition, at the lower end of the conveying tube 100, each helical groove 101 comprises an indentation 102 which is separated from the rest of the groove by a catch 103 which projects downwards. The indentation 102, together with the projecting catch 103, delimits a pocket suitable for receiving the upper portion of the corresponding side post 96 when the applicator device 1 is in the storage position, slightly lifting the conveying tube 100 and the reservoir 20 relative to the bottom 92 of the base 3, as represented in FIG. 23.

Also, as represented in FIG. 24, the reservoir 20 advantageously forms a shoulder 104 facing towards the base 3, at the connection with the conveying tube 100. This shoulder 104 comprises a pin 105 projecting towards the bottom 92 of the base 3, the pin 105 able to move angularly in the notch 85 of the shoulder 84 of the external body 2, said pin 105 pressing on the notch 85 and against the first stop face 86 when the applicator device 1 is in the storage position. In this storage position, the pin 105 and the side posts 95 of the rod 16 contribute to maintaining the reservoir 20 and the conveying tube 100 in a slightly raised position, at a distance from the bottom 92 of the base 3, as represented in FIG. 23.

As represented in FIGS. 19 and 20, a piston 32, similar to the one already described, slides within the cylindrical side wall 97 of the reservoir 20 while maintaining the seal, this piston 32 also sliding on the rod 16 along the axis X while maintaining the seal.

The applicator device additionally comprises a piston spring 34 similar to the one already described, in the form of a coil spring, arranged around the rod 16 and at the center of the fins 95, the piston spring pressing on the one hand against the bottom 12 of the base 3 and on the other hand against the piston 32, passing through the opening 99 in the bottom of the reservoir. This piston spring 34 is only slightly compressed in the storage position of the applicator device, or even uncompressed if the piston is in the top position in the reservoir.

As represented in FIGS. 26 to 29, the distal end of the reservoir 20 is equipped with a wringer 50, similar to the one described in the first embodiment, which comprises a radial inner lip 51 able to establish a seal either against the free end 18 of the rod 16 when said rod 16 is in the retracted position, or against a portion of the rod 16 located before the applicator head 19 when the rod 16 is in the extended position.

This wringer 50 fits together with the plug valve control member 60 and is solidly connected to the distal end of the reservoir 20 by any known means. In addition, the cap 52 of the applicator device is also similar to the one described for the first embodiment, and, as before, comprises a lip 53 extending radially inwards and delimiting a central opening 54, this cap 52 being attached by any known means to the upper end of the external body 2, for example by fitting it into the side wall 81 of this external body and possibly snapping an internal annular rib 83*a* of the external body 2 into an annular groove 52*a* of the cap (see FIGS. 25 to 29).

As in the first embodiment, the inside of the cap 52 comprises oblong pockets 55 parallel to the axis X, and studs 56 that are part of the plug valve 57 are assembled to slide within them with lost motion, allowing said plug valve to pivot on a transverse axis Y that is perpendicular to the axis X, as in the first embodiment. As before, the spherical plug valve 57 delimits a central passage 58 which, in the storage position of the applicator device 1, is arranged perpendicularly to the central axis X.

Also, as in the first embodiment of the invention, the plug valve 57 is resiliently biased towards the lip 53 of the cap by a control device 59 which comprises, as in the first embodiment:

- a plug valve control member 50 of a form similar to that of the first embodiment, comprising, as described above, a pin 63 engaged with an angled groove 64 of the spherical plug valve 57, and an annular supporting portion 65 that is in contact with the lower portion of the spherical plug valve 57,
- a metal coil spring 61 which, here, presses axially against the wringer 50 solidly connected to the distal end 23 of the reservoir 20 and which directly biases the spherical plug valve 57 towards the sealing lip 53 of the cap, so as to ensure a fluid-tight contact of the plug valve against said sealing lip,
- and a supporting ring 62 which is solidly connected to the distal end 23 of the reservoir 20.

Figure 22:
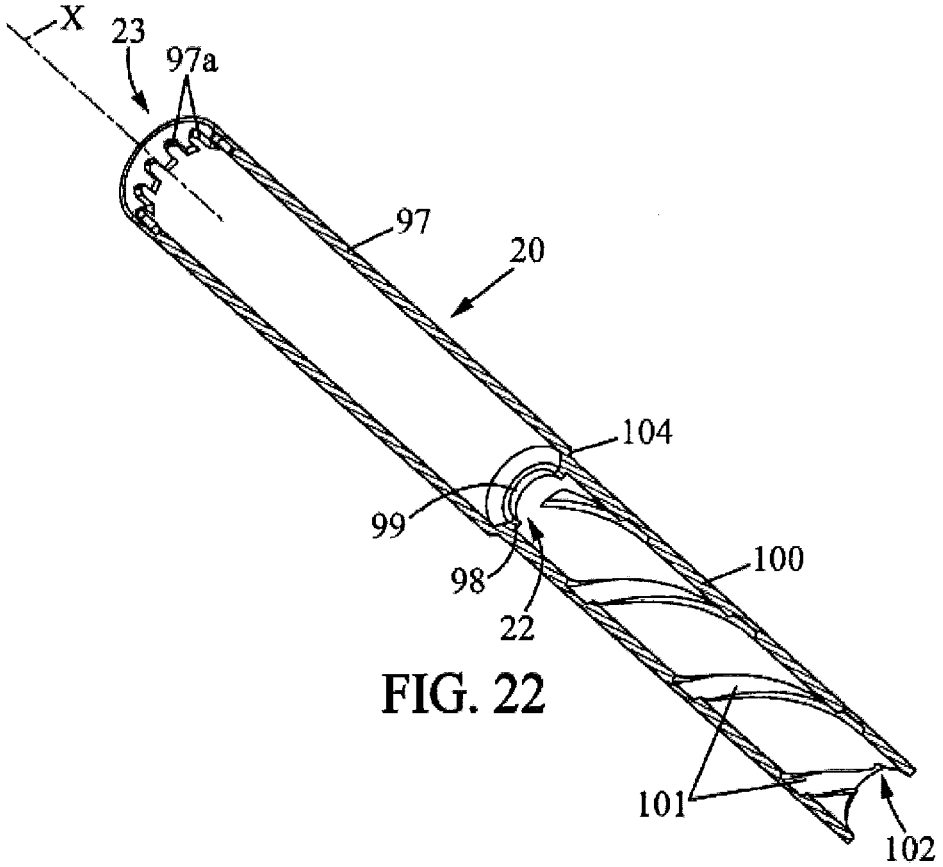
FIG. 22 is an axial cross-sectional perspective view showing the reservoir of the applicator device of FIG. 18 and the conveying tube connected to it.
Figure 26:
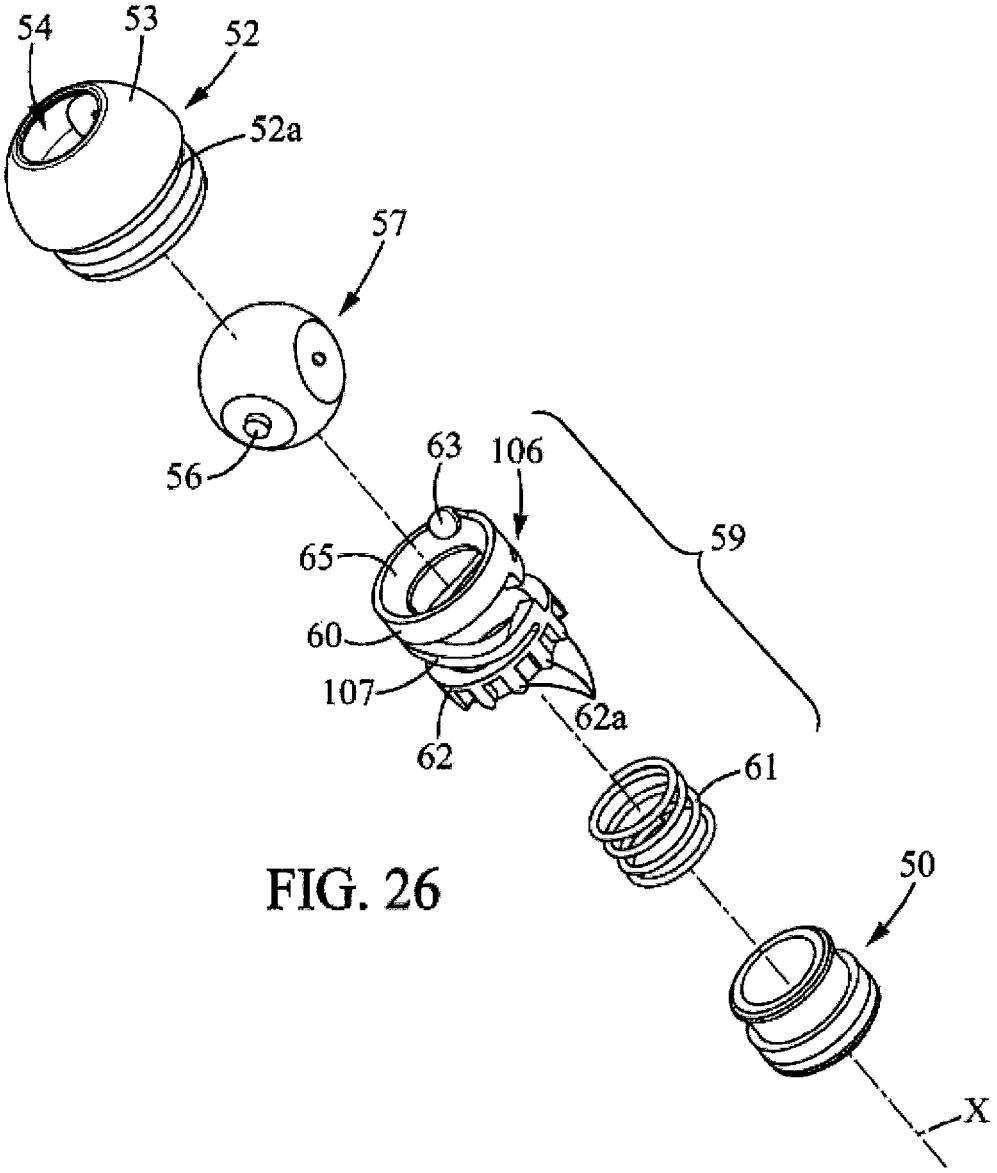
Figure 27:
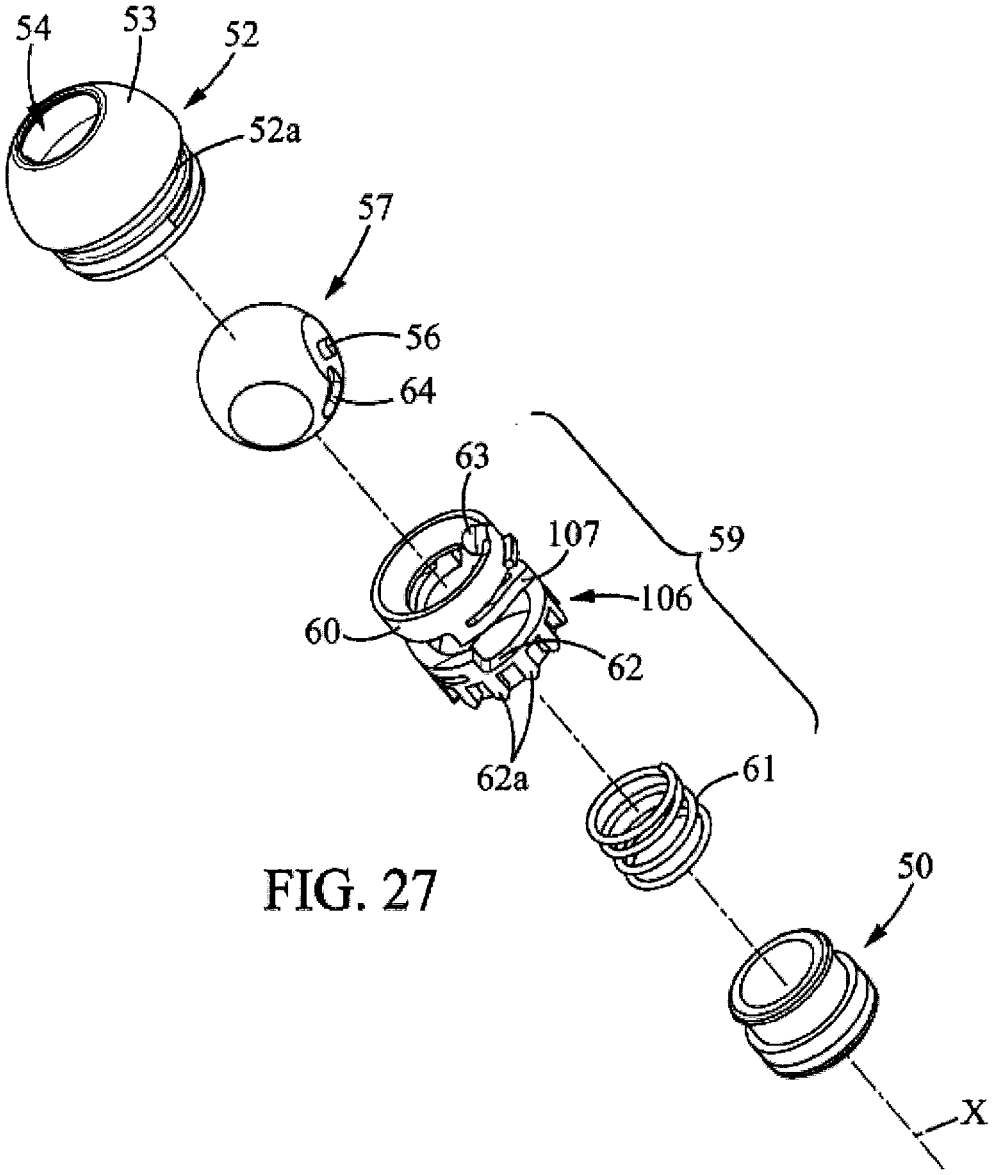
Figure 28:
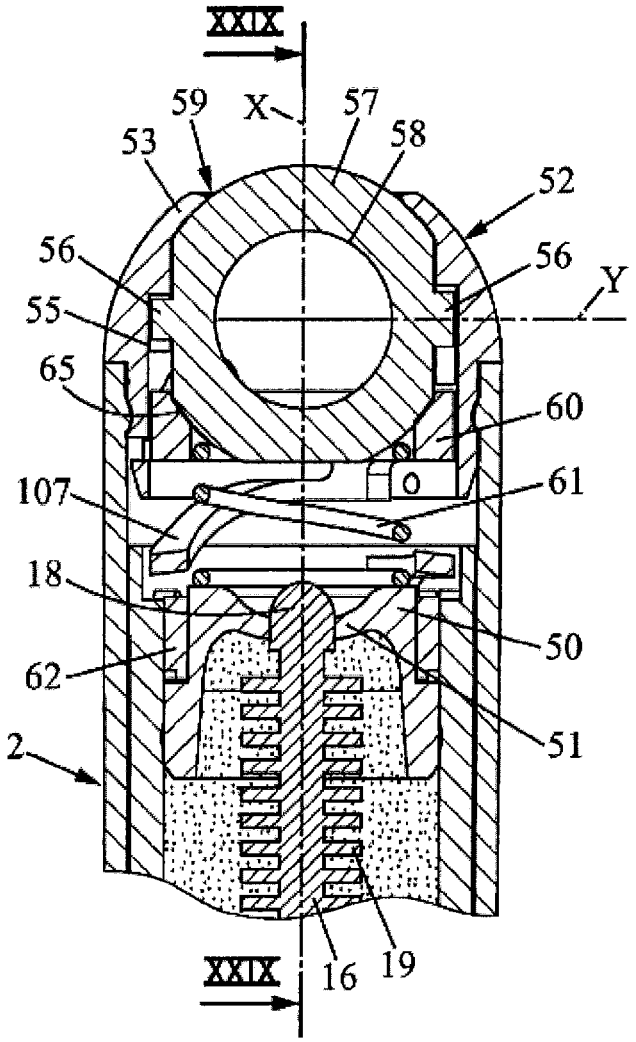
FIG. 28 is an axial cross-sectional view of the upper portion of the applicator device of FIG. 18 in the stored position.
Figure 29:
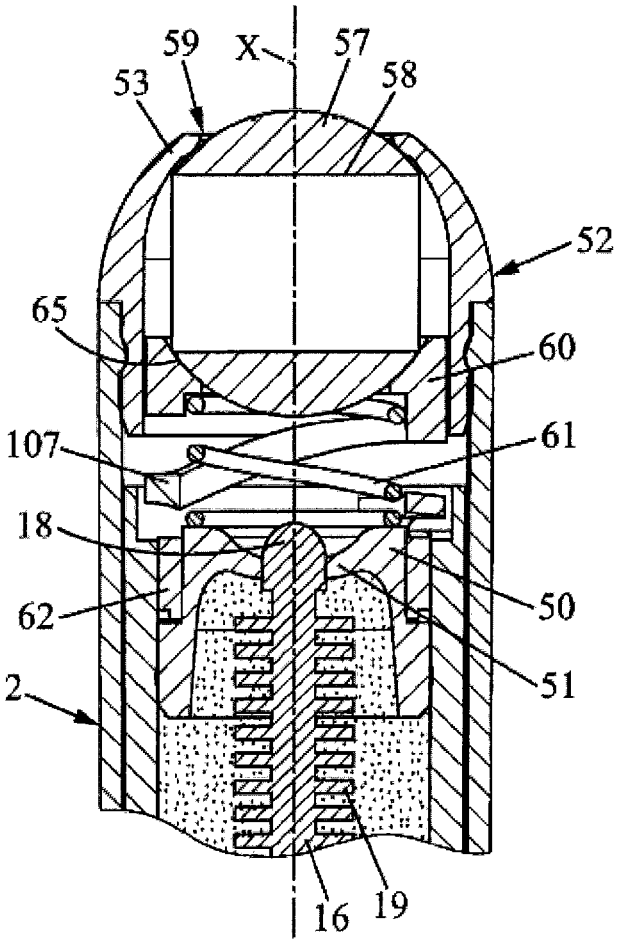
FIG. 29 is a cross-sectional view along line XXIX-XXIX of FIG. 28.
Figure 30:
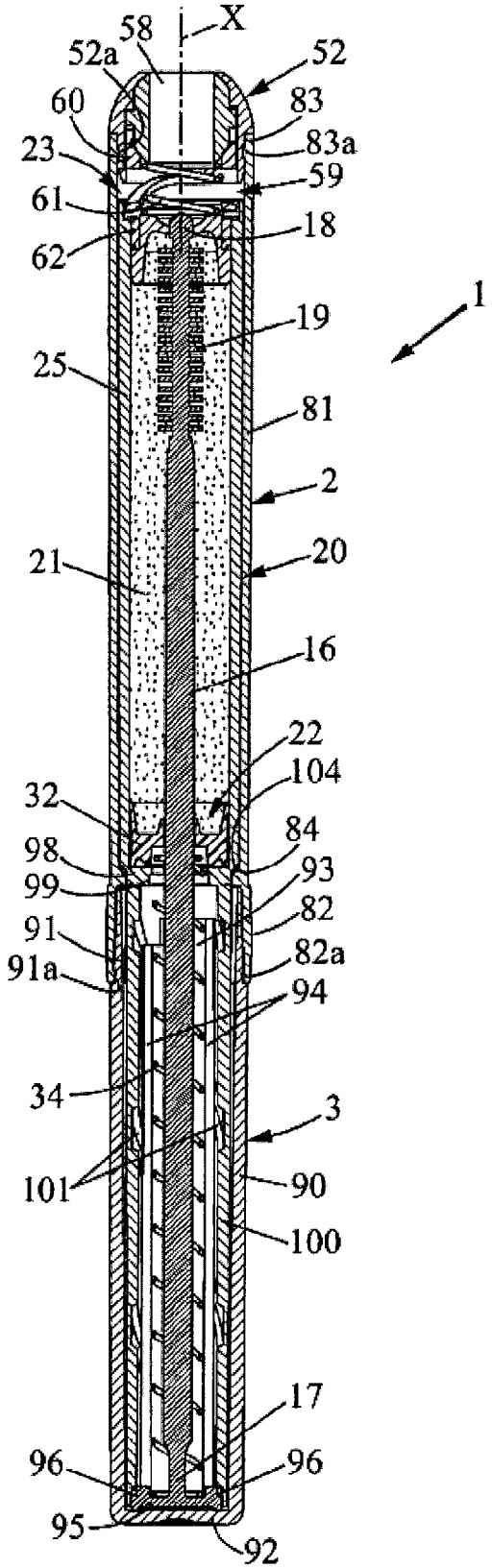
FIG. 30 is an axial cross-sectional view of the applicator device of FIG. 18, in the open position of the plug valve.
Figure 31:
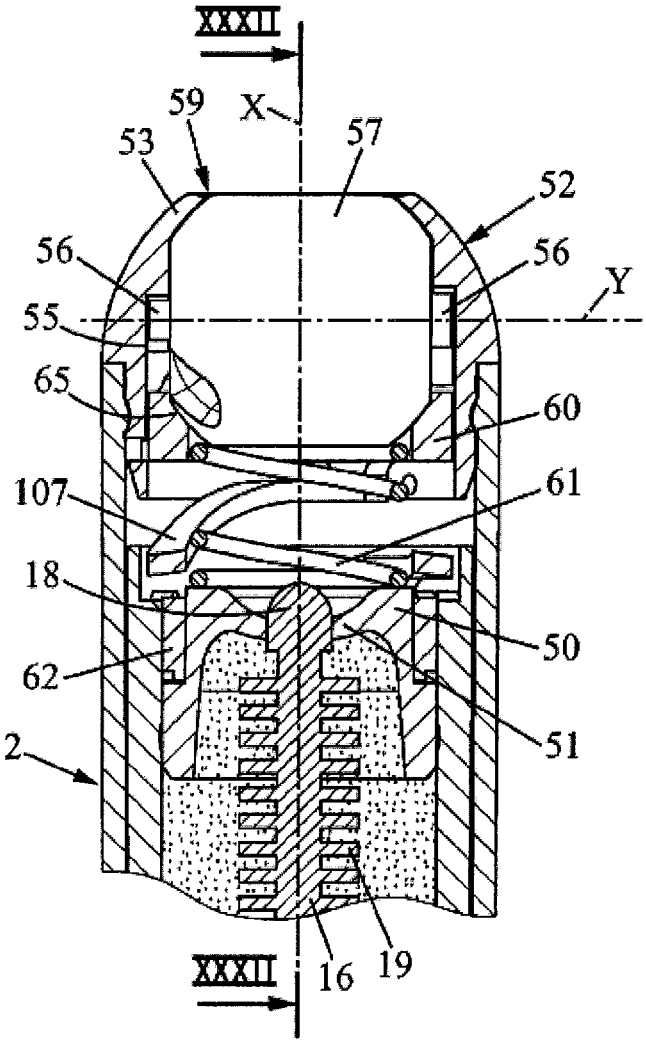
FIG. 31 is a detailed view of an axial cross-section showing the upper portion of the applicator device of FIG. 30, without cross-sectioning the plug valve.
Figure 32:
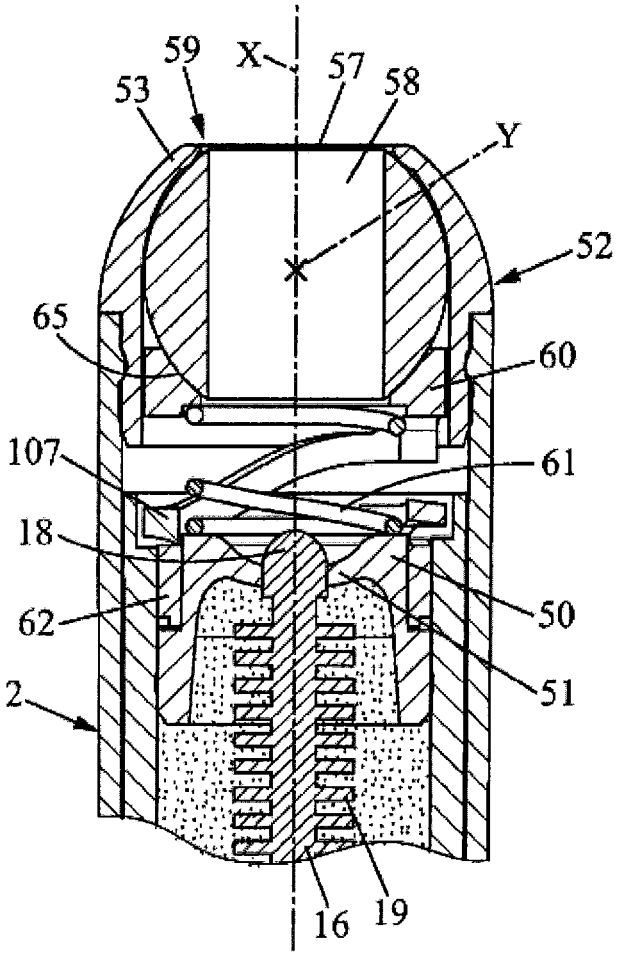
FIG. 32 is an axial cross-sectional view along line XXXII-XXXII of FIG. 31.

In the example represented, the supporting ring 62 comprises axial teeth 62*a* which interlock with axial teeth 97*a* formed at the distal end of the reservoir 1 (see FIGS. 22, 26 and 27).

In addition, as represented in FIGS. 26 to 29, the plug valve control member 60 is formed of the same piece of plastic material as the supporting ring 62, and a supplemental plug valve spring 107 of plastic which connects the plug valve control member 60 to the supporting ring 62.

The applicator device of the second embodiment of the invention operates as follows.

From the storage position represented in FIGS. 18, 19, 28, 29, when the user rotates the base 3 in the first angular direction 4 about the central axis X, this rotation of the base 3 also causes a rotation of the rod 16 and of the rod foot 95, and the side posts 96, caught in the indentations 102 of the conveying tube 100, also force the conveying tube 100 to rotate in the first angular direction 4. During this motion, the pin 105 of the reservoir 20 is advanced along the notch 85 in the first angular direction 4 (see FIG. 25), until it comes against the stop face 87 which then prevents the reservoir 20 from continuing to rotate relative to the external body 2. During this first path section of the base 3, the reservoir 3 rotates the plug valve control member 60 which causes the plug valve 57 to pivot to the open position represented in FIGS. 30 to 32.

The user then continues to turn the base 3 in the first angular direction 4, but in this second section of the base 3 actuation path, the reservoir 20 is no longer able to turn relative to the external body 2, as the pin 105 of the reservoir is stopped by the stop face 87 of the external body 2 (see FIG. 25). The side posts 96 of the rod foot 95 exit the indentations 102 as a result, slightly raising the conveying tube 100 as the side posts 96 pass under the projecting catch 103, after which the lower end of the conveying tube 100 comes to rest against the bottom 92 of the base 3 and the pin 105 of the reservoir simultaneously enters the indentation 89 of the external body 2.

In the rest of the rotational movement of the base 3 in the first angular direction 4, the side posts 96 of the rod foot 95 are advanced upwards by helical grooves 101, which causes the rod 16 to slide axially upwards, said side posts 96 being guided by their axial slide within the slots 94 between the fins 93 of the base 3.

Figure 33:
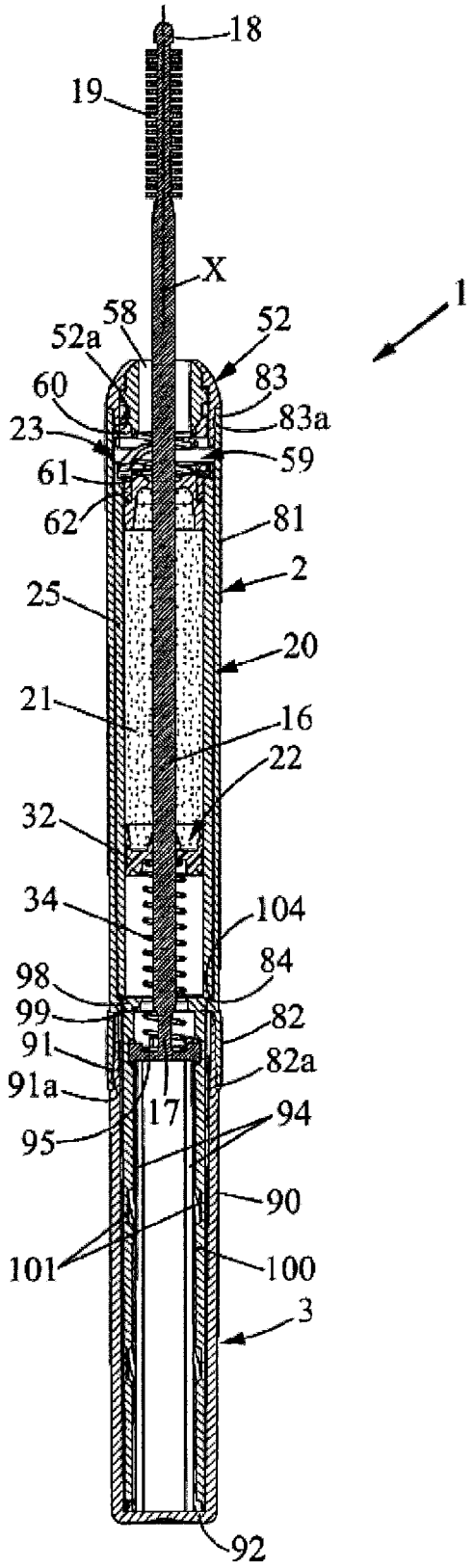
FIG. 33 is an axial cross-sectional view of the applicator device of FIG. 18, in the utilization position.

During this motion, the rod 16 is advanced to the extended position visible in FIG. 33 where the applicator head 19 of the rod 16 is extended beyond the external body 2 and the rod 16 traverses the central passage 58 of the spherical plug valve while establishing a seal with the lip 51 of the wringer 50. The applicator device 1 is then in the utilization position, and, as in the first embodiment of the invention, the piston spring 34 is thus compressed which causes the piston 32 to move slightly towards the wringer 50 to compensate for the product 21 removed by the applicator head, so that the space between the piston 32 and the wringer 50 is always completely filled with product 21.

To return the applicator device 1 to the storage position after use, the user simply needs to turn the base 3 relative to the external body 2 in the second angular direction 5 opposite the first angular direction 4, which firstly causes an inward motion of the rod 16 as it slides axially towards the bottom 32 of the base 3, then, when the rod foot 95 comes to a stop against the bottom 32 of the base 3, the side posts 96 of the rod foot 95 again penetrate the indentations 102 in the lower portion of the conveying tube 100, which causes the pin 105 of the reservoir 20 to exit the indentation 89 and then allows angular advancement of the pin 105 in the notch 85 until it reaches the stop face 86 of this notch (see FIG. 25), which thus allows closing the spherical plug valve 57 and returning to the storage position. It should be noted that at the end of this motion, the catch 88 of the notch 85 can guide the user by forming a more difficult point and possibly causing an audible "click" at the end of the travel.

C. Third Embodiment of the Invention

The third embodiment of the invention is similar to the second embodiment already described above, and therefore will not be described in its entirety: only the elements which differ from the second embodiment will be described below.

This third embodiment differs from the second embodiment essentially in the following points, visible in FIGS. 34 to 37:

- the foot 95 of the rod 16 comprises a pin 110 which projects axially towards the bottom 92 of the base 3 (FIG. 34) and which presses axially against this bottom 92 in the storage position of the device; the side posts 96 of the rod foot 95 are then at the lower end of the helical grooves 101 in this storage position, with the conveying tube 100 then being kept apart from the bottom 92 of the base 3 while also raising the reservoir 20 towards the cap 52;
- the helical grooves 101 of the conveying tube 100 do not have the indentations 102 and catches 103;
- the notch 85 of the external body 2 and the pin 105 of the reservoir 20 are eliminated; the reservoir 20 is solidly connected to the external body 2, so as to rotate with it, by mutually interlocking axial grooves 111, 112 arranged respectively in the inside of the side wall 81 of the external body 2 and on the outside of the side wall 97 of the reservoir 20; these axial grooves enable a relative sliding of the two parts 2, 20 along the axis X;
- the plug valve control member 60 and the supporting ring 62 are two distinct parts, which respectively comprise cylindrical skirts 113, 114 centered on the axis X and fitting one inside the other, these two skirts being linked to each other by an angled track which imposes a relative rotational motion between the plug valve control member 60 and the supporting ring 62 when these two parts slide along the axis X relative to each other (see FIGS. 35 to 37), positioning the spherical plug valve 57 in the closed position when the supporting ring 62 is brought as close as possible to the plug valve control member 60, as is the case when the applicator device is in the storage position: in the example considered here, said angled track comprises two external helical grooves 115 in the cylindrical skirt 113 of the plug valve control member, within which two internal pins 116 of the skirt 114 of the supporting ring 62 respectively slide;
- the plug valve spring 61 is assembled inside the cylindrical skirts 113, 114 and presses against the plug valve control member 60 and the supporting ring 62 where it biases these two parts apart from each other, instead of being assembled between the wringer 50 and the plug valve 57;
- the supplemental plug valve spring 107 is eliminated;
- the supporting ring 62 presses axially against the wringer 50 which itself is solidly connected to the distal end 23 of the reservoir (the supporting ring 62 may in addition possibly hook onto the wringer 50, as in the example represented);
- an anti-friction ring 117, made for example of Teflon, is placed axially between the plug valve spring 61 and the supporting ring 62 to allow easy relative rotation between the plug valve spring 61 and the supporting ring 62 (this anti-friction ring could possibly be placed between the plug valve spring 61 and the plug valve control member 60).

The device according to the third embodiment operates as follows.

Figure 34:
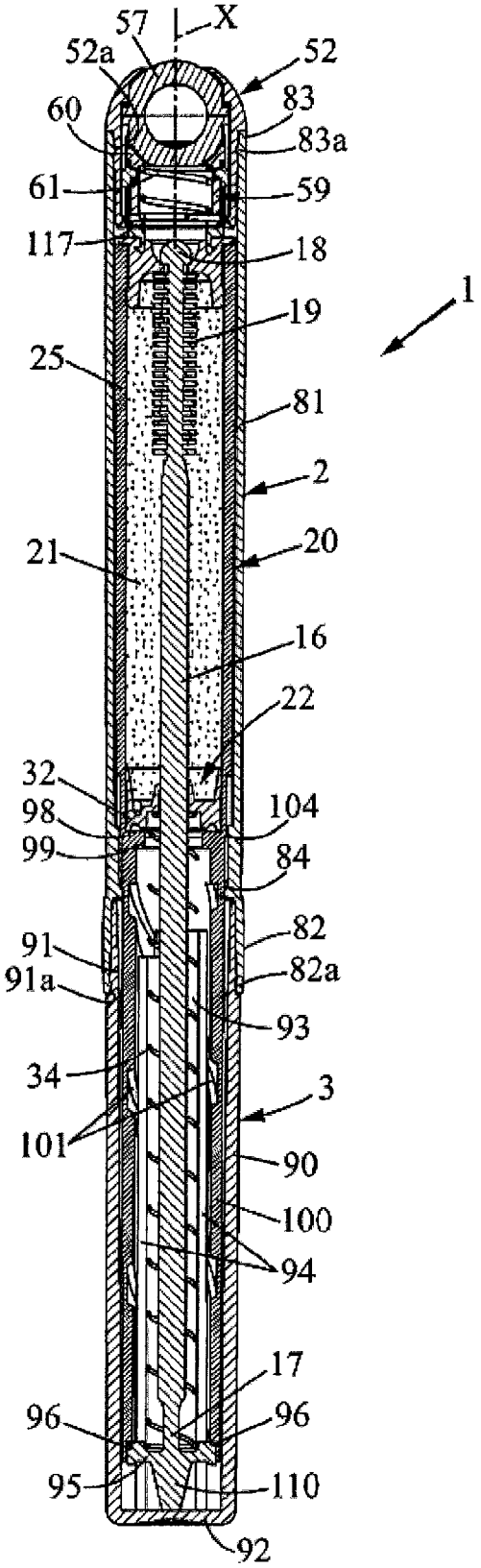
FIG. 34 is an axial cross-sectional view of an applicator device according to a third embodiment of the invention, in the stored position.
Figure 35:
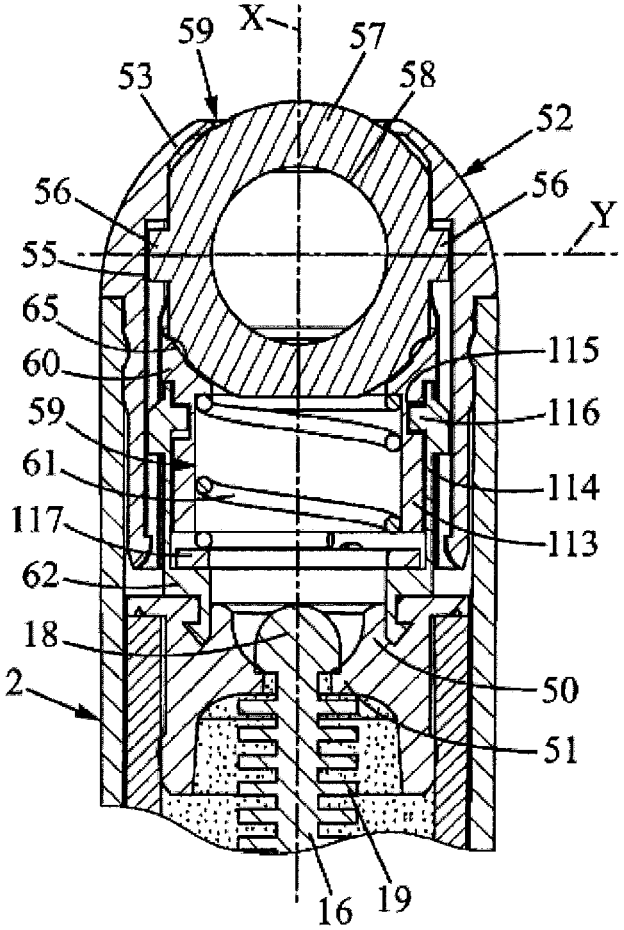
FIG. 35 is a detailed axial cross-sectional view showing the upper portion of the applicator device of FIG. 34, in the stored position.
Figure 36:
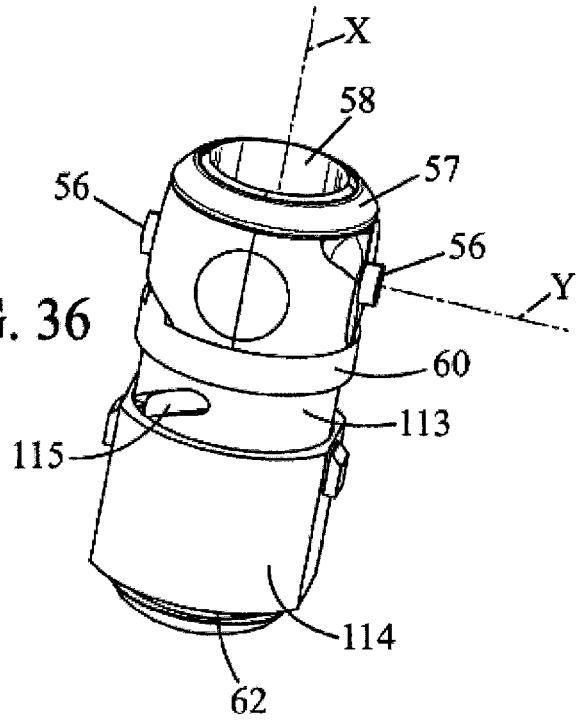
FIGS. 36 and 37 are detailed perspective views showing the plug valve of the applicator device of FIG. 34 and its control device, with the plug valve in the open position, these elements being viewed from two different angles.
Figure 37:
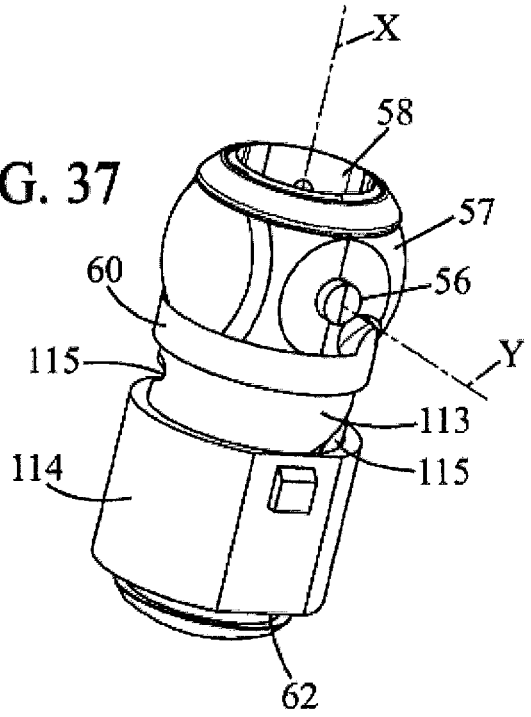

Starting from the storage position represented in FIGS. 34 and 35, when the user turns the base 3 in the first angular direction 4 about the central axis X, this rotation of the base 3 also causes the rod 16 and the rod foot 95 to rotate, which first of all allows the conveying tube 100 to descend towards the bottom 92 of the base 3.

During this first section of the path of the base 3, the descent of the conveying tube 100 and of the reservoir 20 towards the bottom 92 of the base 3 causes the supporting ring 62 and the plug valve control member 60 to move apart from each other, due to the effect of the plug valve spring 61. This distancing causes a rotation of the plug valve control member 60 in the direction corresponding to the opening of the spherical plug valve 57.

Figure 38:
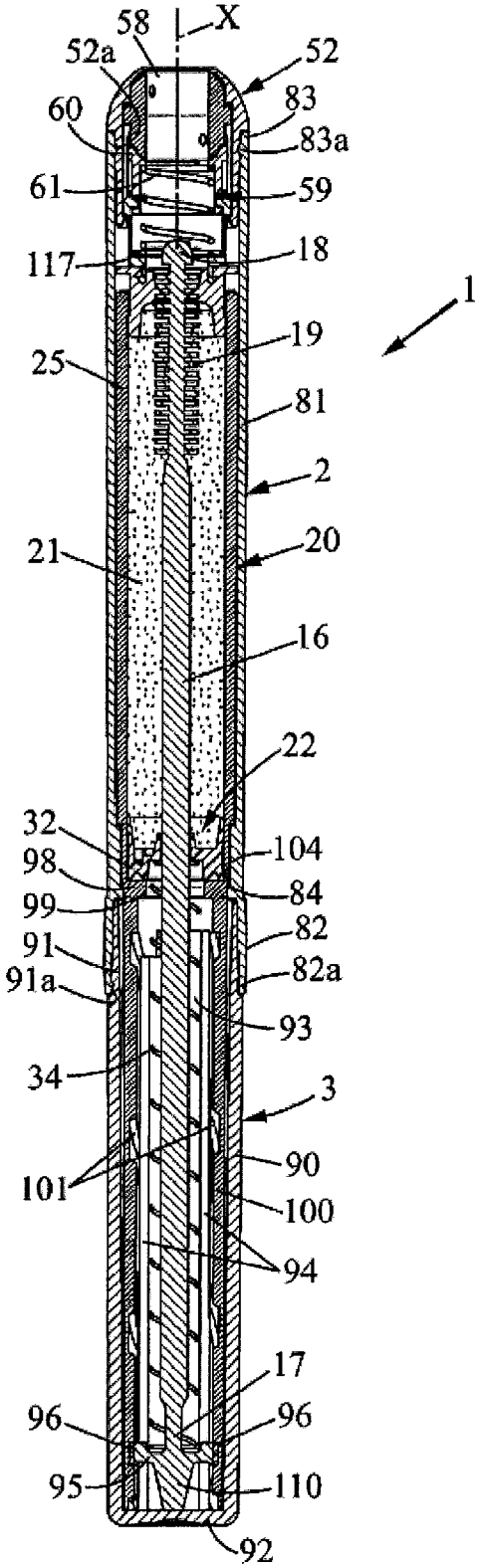
FIG. 38 is an axial cross-sectional view of the applicator device of FIG. 34, with the plug valve in the open position.
Figure 39:
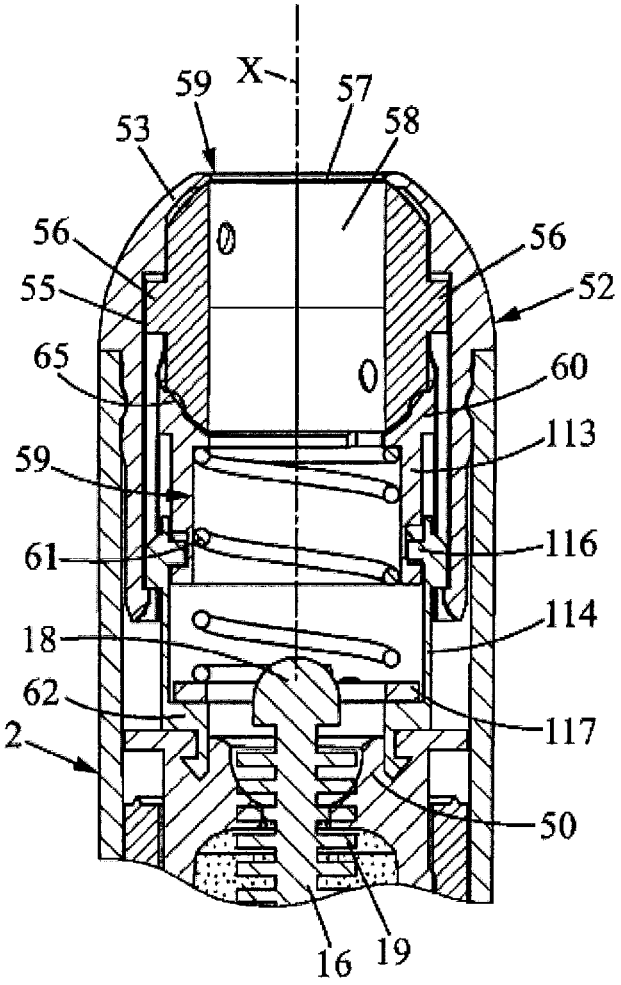
FIG. 39 is a detailed view of an axial cross-section showing the upper portion of the applicator device of FIG. 37 with the plug valve in the open position.

When the lower end of the conveying tube 100 comes to a stop against the bottom 92 of the base 3, the spherical plug valve 57 is in the open position, with its central passage oriented along the axis X (FIGS. 38 and 39).

Figure 40:
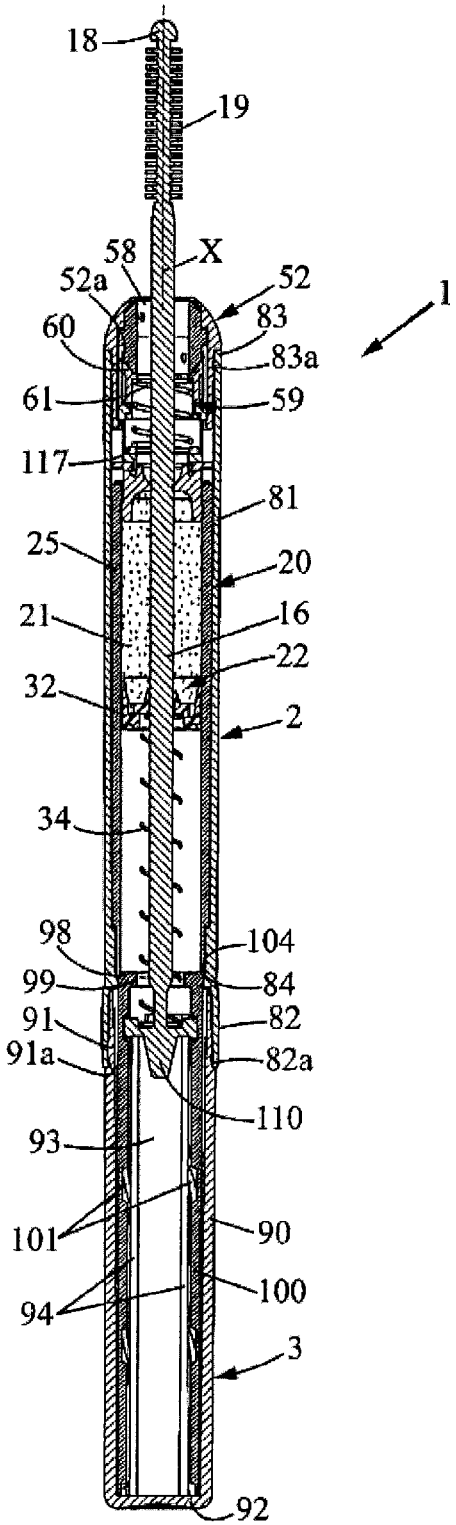
FIG. 40 is an axial cross-sectional view showing the applicator device of FIG. 34 in the utilization position.

The user then continues to rotate the base 3 in the first angular direction 4, but in this second portion of the base 3 actuation path, the conveying tube 10 is pressing against the bottom 92 of the base 3, therefore the side posts 96 of the rod foot 95 slide upwards along the axial slits 94 in the base, driven by the helical grooves 101 of the conveying tube. The rod 16 then moves to the extended position visible in FIG. 40 where the applicator head 19 of the rod is extended beyond the external body 2 and the rod 16 traverses the central passage 58 of the spherical plug valve while maintaining a seal with the lip 51 of the wringer 50. The applicator device 1 is then in the utilization position and, as in the first and second embodiments of the invention, the piston spring 34 is thus compressed and causes the piston 32 to move slightly towards the wringer 50 to compensate for the product 21 removed by the applicator head, such that the space between the piston 32 and the wringer 50 is always completely filled with product 21.

To return the applicator device 1 to the storage position after use, the user simply needs to rotate the base 3 relative to the external body 2 in the second angular direction 5, opposite the first angular direction 4, which firstly causes an inward movement of the rod 16 as it slides axially towards the bottom 92 of the base 3, then, when the pin 110 of the rod foot 95 is stopped by the bottom 92 of the base 3, the conveying tube 100 is once again raised relative to the bottom 92 of the base, which actuates the plug valve control device 59 and returns the spherical plug valve to the closed position and once again places the applicator device 1 in the storage position.

The invention claimed is:

1. An applicator device comprising:

a reservoir suitable for containing a product to be applied, this reservoir extending along a central axis between a proximal end and a distal end, and said reservoir being axially open at said distal end, a cap that is connected to the distal end of the reservoir, said cap comprising an opening on the central axis, a spherical plug valve mounted in the cap so as to pivot about a transverse axis perpendicular to the central axis, said plug valve comprising a central passage perpendicular to the transverse axis and said plug valve pivotable between:

a closed position in which said plug valve closes the opening in the cap, and an open position in which said central passage of the plug valve is aligned with the opening in the cap, a plug valve control member, movable between a closed position and an open position, and able to place the plug valve in the closed position when said plug valve control member is in the closed position and to place the plug valve in the open position when said plug valve control member is in the open position, a rod extending along the central axis to a free end equipped with an applicator head suitable for applying said product, said rod being movable at least translationally along the central axis, between:

a retracted position in which the applicator head is positioned within the reservoir, and an extended position in which the rod traverses the central passage of the plug valve and the applicator head is outside the reservoir, wherein the plug valve control member is rotatable about the central axis, between the closed position and the open position, wherein the reservoir is mounted within an external body solidly connected to the cap, and wherein the rod traverses the proximal end of the reservoir and is mounted in a base which axially extends the reservoir from the proximal end of said reservoir, said base being movable relative to the external body along an actuating path comprising a first path section between a rest position and an intermediate position, and a second path section between said intermediate position and a utilization position, said first path section comprising a rotational movement of the base relative to the external body about the central axis, said base being coupled to the plug valve control member so as to rotate said plug valve control member from the closed position to the open position when the base is moved from the rest position to the intermediate position, and said base being adapted to move the rod from the retracted position to the extended position during the second path section.

2. The applicator device according to claim 1, comprising a piston mounted so as to slide in the reservoir while maintaining the seal and traversed by the rod while maintaining the seal, the piston being resiliently biased towards the distal end of the reservoir.

3. The applicator device according to claim 2, wherein the piston is resiliently biased by a piston spring having a first end related to the rod and a second end pressing against the piston.

4. The applicator device according to claim 1, wherein the distal end of the reservoir comprises a wringer which is adapted to wring the applicator head and/or the rod when said applicator head exits the reservoir, the free end of the rod being adapted to establish a seal with the wringer when the rod is in the retracted position, said rod additionally comprising an intermediate portion which is located before the applicator head and which is adapted to establish a seal with the wringer when said rod is in the extended position.

5. The applicator device according to claim 1, wherein the plug valve control member comprises a pin slidingly engaged in an angled groove of the plug valve.

6. The applicator device according to claim 1, wherein the cap comprises an annular lip, the plug valve is mounted in the cap so as to have play along the central axis, the plug valve control member is mounted so as to have play along the central axis relative to the cap and is resiliently biased towards the plug valve, said plug valve control member coming into contact with the plug valve and pressing said plug valve into axial contact with the lip of the cap.

7. The applicator device according to claim 6, wherein the plug valve control member is resiliently biased towards the annular lip by a plug valve spring pressing against the reservoir.

8. The applicator device according to claim 7, wherein the plug valve spring presses against a supporting ring which itself is supported by the distal end of the reservoir.

9. The applicator device according to claim 1, wherein the plug valve control member is solidly connected to the reservoir such that it rotates with the reservoir.

10. The applicator device according to claim 9, wherein the reservoir is mounted so as to rotate with lost motion relative to the external body, about the central axis, said first path section including a rotation of the base with the reservoir about the central axis.

11. The applicator device according to claim 10, wherein the base is mounted so as to rotate with lost motion on the reservoir, about the central axis, starting from the initial position of said base, with a range of rotation that is less than the angular extent of the first path section, said first path section including a rotation of the base relative to the reservoir and then a rotation of the base with the reservoir about the central axis.

12. The applicator device according to claim 11, wherein the base is connected to the reservoir by at least one L-shaped track comprising:

an orthoradial arm which permits said rotation of the base relative to the reservoir during the first path section, and an axial arm parallel to the central axis and allowing the base to slide relative to the reservoir in the direction of the distal end of said reservoir when the base follows the second path section from the intermediate position to the final position.

13. The applicator device according to claim 12, wherein the base is resiliently biased to move away from the reservoir and is connected to the reservoir by a retention mechanism suitable for selectively either retaining said base in the final position or releasing said base to enable it to move from the final position to the intermediate position.

14. The applicator device according to claim 13, wherein the retention mechanism is adapted to lock the base in place automatically when it reaches the final position.

15. The applicator device according to claim 14, wherein the retention mechanism is a two-state mechanism adapted to release the base when it is axially actuated towards the distal end of the reservoir after it had been locked in the final position.

16. The applicator device according to claim 15, wherein the retention mechanism comprises a winding path arranged in an outer wall of the reservoir, cooperating with a pin supported by an elastic strip solidly connected to the base.

17. The applicator device according to claim 1, wherein the base is rotatably mounted on the external body and the actuating path comprises a circular movement about the central axis which includes the first and second path sections, the rod being guided by a first track that is integral to the base and by a second track that is integral to the reservoir, so that a rotation of the base relative to the reservoir causes an axial displacement of the rod between the retracted and extended positions.

18. The applicator device according to claim 17, wherein the first track is parallel to the central axis and the second track is helical.

19. The applicator device according to claim 18, wherein the reservoir is axially extended beyond its proximal end, by a conveying tube which is solidly connected to said reservoir, the second track extending in a spiral inside the conveying tube between a first end further from the reservoir and a second end closer to the reservoir, the rod extending inside said conveying tube to a foot which comprises at least one side post guided in the first and second tracks.

20. The applicator device according to claim 19, wherein:

the plug valve control member is solidly connected to the reservoir so as to rotate with it, and is resiliently biased towards the plug valve by a plug valve spring pressing against the reservoir, the reservoir is axially movable within the external body between an engaged position and a disengaged position that is closer to the plug valve than the engaged position, the reservoir and the external body being adapted to:

couple together when the reservoir is in the engaged position, such that the reservoir is then solidly connected to the external body, and uncouple when the reservoir is in the disengaged position, such that the reservoir can then turn freely within the external body, at least the open position of the plug valve control member is in a stop position, the base comprises a bottom opposite the reservoir, and the conveying tube is axially open facing said bottom, the foot of the rod is adapted to press axially against the bottom of the base when the rod is in the retracted position, and the first end of the second track comprises a catch which opens axially towards the bottom of the base and is adapted to receive the side post of the foot of the rod when the foot of the rod is pressing against the bottom of the base, the catch and the side post being designed to maintain the reservoir in the disengaged position and to allow the reservoir to be rotated by the base when the side post is engaged with the catch, said catch being designed so that the side post of the foot of the rod can escape said catch when the base is actuated in a first angular direction corresponding to the opening of the plug valve and to the plug valve control member having reached the open position, thus allowing the reservoir to move into the engaged position such that the plug valve is locked in the open position and such that an additional rotation of the base in the first angular direction then results in the side post of the rod sliding in the first and second tracks, causing the applicator head of the rod to exit through the plug valve.

21. The applicator device according to claim 20, wherein the reservoir is solidly connected to a pin held in place by the plug valve spring while pressing axially against an edge formed in the external body, said edge extending angularly around the central axis between a first stop and a second stop in the first angular direction, and said edge being discontinuous due to an indentation near the second stop, this indentation being adapted to receive the pin of the reservoir when it comes in contact with the second stop the reservoir being in the disengaged position when the pin of said reservoir is pressing against the edge and being in the engaged position when the pin of the reservoir is within the indentation.

22. The applicator device according to claim 19, wherein:

the plug valve control device is mounted so as to slide at an angle relative to the central axis relative to a supporting ring axially pressing against the distal end of the reservoir, such that moving the supporting ring away from the plug valve control member causes said plug valve control member to rotate from the closed position to the open position, the plug valve control member is resiliently biased towards the plug valve by a plug valve spring pressing against the supporting ring, the reservoir is solidly connected to the external body so as to rotate with it but can move axially within the external body between first and second positions, the first position being closer to the plug valve than the second position, the base comprises a bottom opposite the reservoir and the conveying tube is axially open towards said bottom, the conveying tube and the foot of the rod being adapted to alternate in pressing axially against the bottom of the base, the foot of the rod comprises a supporting region that is axially offset towards the bottom of the base relative to the side post of said foot, said supporting region being adapted to press against the bottom of the base when the rod is in the retracted position and the base is in the first section of the path, while the conveying tube is distanced from the bottom of the base, and the conveying tube is adapted so that it presses against the bottom of the base during the second path section of the base, such that a rotation of the base relative to the external body then causes an axial displacement of the rod relative to the external body.

23. The use of an applicator device according to claim 1, in order to apply a cosmetic product, preferably a liquid or paste cosmetic product.

* * * * *